US008128547B2

(12) United States Patent
Graham et al.

(10) Patent No.: US 8,128,547 B2
(45) Date of Patent: Mar. 6, 2012

(54) METHODS AND MACHINES FOR FORMING A POLYGONAL CONTAINER

(75) Inventors: Thomas Dean Graham, Winter Garden, FL (US); Amer Aganovic, Orlando, FL (US); Robert Bradley Teany, Clermont, FL (US); Tuan Xuan Tran, Orlando, FL (US); John Herschel Conley, Windermere, FL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 208 days.

(21) Appl. No.: 12/239,396

(22) Filed: Sep. 26, 2008

(65) Prior Publication Data

US 2009/0098991 A1 Apr. 16, 2009

Related U.S. Application Data

(60) Provisional application No. 60/979,000, filed on Oct. 10, 2007.

(51) Int. Cl.
*B31B 1/80* (2006.01)

(52) U.S. Cl. ..... 493/313; 493/167; 493/181; 493/182; 493/309; 493/316; 53/381.1; 53/564

(58) Field of Classification Search ..... 493/167, 493/171, 309, 313, 314, 316, 180–182; 53/382.1, 53/383.1, 382.2, 382.3, 564
See application file for complete search history.

(56) References Cited

U.S. PATENT DOCUMENTS 5,147,271 A 9/1992 Bacques et al.
(Continued)

*Primary Examiner* — Christopher Harmon
(74) *Attorney, Agent, or Firm* — Armstrong Teasdale LLP

(57) ABSTRACT

A machine for erecting a polygonal container from a knocked-down flat (KDF) container formed from a blank of sheet material is provided. The container includes four main side panels, at least one corner panel extending between two of the main side panels, and at least one bottom flap extending from one of the main side panels. The machine includes a body, a first erecting mechanism coupled to the body, and a second erecting mechanism coupled to the body. The first erecting mechanism receives the KDF container and erects the KDF container into a partially erected container having a substantially rectangular configuration, and the second erecting mechanism receives the partially erected container and erects the partially erected container from the substantially rectangular configuration into the polygonal container by applying a force to an exterior surface of the partially erected container to erect the polygonal container that has more than four sides.

24 Claims, 23 Drawing Sheets

U.S. PATENT DOCUMENTS 5,624,368 A * 4/1997 Cromwell ..... 493/312
5,656,006 A * 8/1997 East et al. ..... 493/171
5,807,225 A 9/1998 Nowacki et al.
6,106,450 A * 8/2000 Brittain ..... 493/171
6,571,539 B2 * 6/2003 Gendre et al. ..... 53/456

* cited by examiner

METHODS AND MACHINES FOR FORMING A POLYGONAL CONTAINER

CROSS REFERENCE TO RELATED APPLICATIONS

This patent application claims priority to U.S. Provisional Patent Application Ser. No. 60/979,000, filed on Oct. 10, 2007, which is hereby incorporated by reference in its entirety.

BACKGROUND OF THE INVENTION

The embodiments described herein relate generally to packaging products and, more specifically, to methods and systems for forming a polygonal container from a knocked-down flat container made from cardboard, corrugated paperboard, or other similar sheet material.

Containers are frequently utilized to store and aid in transporting products. These containers can be square, hexagonal, or octagonal. The shape of the container can provide additional strength to the container and can provide a more secure fit of the product contained within the container. For example, an octagonal-shaped container oftentimes provides greater stacking strength and greater resistance to bulge over conventional rectangular or square containers.

Product manufacturers and packaging companies commonly utilize containers in a knocked-down flat state when shipping the containers to the product manufacturers and when storing the containers at the product manufacturer's before loading the containers with the product to be shipped. Knocked-down flats are formed from a blank of sheet material and can be erected to form a container for packaging and shipping. In at least some known cases, such knocked-down flats are erected at the manufacturer of the product to be shipped using a case erector machine that individually erects each knocked-down flat from a stack of knocked-down flats. This process of erecting a shipping container from a knocked-down flat at a location where the shipping container is then loaded with the product for shipment is typically efficient, but is typically only used for forming shipping containers having a rectangular shape.

However, rectangular shaped containers are oftentimes not suitable for a packaging application. Specifically, the item to be packed and shipped may not be rectangular and, therefore, a rectangular shaped package may lack the desired space efficiency. Furthermore, a rectangular shaped package may lack sufficient strength for stacking or bulge resistance. In these types of packaging applications, a shipping container having a non-rectangular configuration is better suited. For example, packages having an octagonal shape including angled corner panels may be required for space efficiency, stacking strength and/or bulge resistance. However, many known methods and systems for erecting shipping containers from a knocked-down flat are insufficient for forming an octagonal container. Moreover, the known methods and systems capable of forming an octagonal container typically include more complicated machinery and, therefore, are more expensive to employ and more complicated to operate.

BRIEF DESCRIPTION OF THE INVENTION

In one aspect, a machine for erecting a polygonal container from a knocked-down flat container formed from a blank of sheet material is provided. The container includes four main side panels, at least one corner panel extending between two of the main side panels, and at least one bottom flap extending from one of the main side panels for forming a bottom of the container. The machine includes a body, a first erecting mechanism coupled to the body, and a second erecting mechanism coupled to the body. The first erecting mechanism is configured to receive the knocked-down flat container and erect the knocked-down flat container into a partially erected container having a substantially rectangular configuration. The second erecting mechanism is configured to receive the partially erected container in the substantially rectangular configuration and erect the partially erected container from the rectangular configuration into the polygonal container by applying a force to an exterior surface of the partially erected container to erect the polygonal container. The polygonal container has more than four sides.

In another aspect, a machine for erecting a polygonal container from a knocked-down flat container formed from a blank of sheet material is provided. The container includes four main side panels, at least one corner panel extending between two of the main side panels, and at least one bottom flap extending from one of the main side panels for forming a bottom of the container. The machine includes means for erecting the knocked-down flat container into a partially erected container having a substantially rectangular configuration and means for further erecting the partially erected container from the substantially rectangular configuration into the polygonal container by applying a force to an exterior surface of the at least one corner panel, wherein the polygonal container has more than four sides.

In still another aspect, a method for erecting a polygonal container from a knocked-down flat container formed from a blank of sheet material is provided. The container includes four main side panels, at least one corner panel extending between two of the main side panels, and at least one bottom flaps extending from one of the main side panels for forming a bottom of the container. The polygonal container is formed using a machine that includes a body, a first erecting mechanism coupled to the body, and a second erecting mechanism coupled to the body. The method includes receiving the knocked-down flat container at the first erecting mechanism, erecting the knocked-down flat container into a partially erected container having a substantially rectangular configuration at the first erecting mechanism, and transferring the partially erected container in the substantially rectangular configuration to the second erecting mechanism. A force is applied to an exterior surface the partially erected container in the substantially rectangular configuration to erect the polygonal container at the second erecting mechanism, wherein the polygonal container has more than four sides.

DETAILED DESCRIPTION OF THE INVENTION

Figure 1:
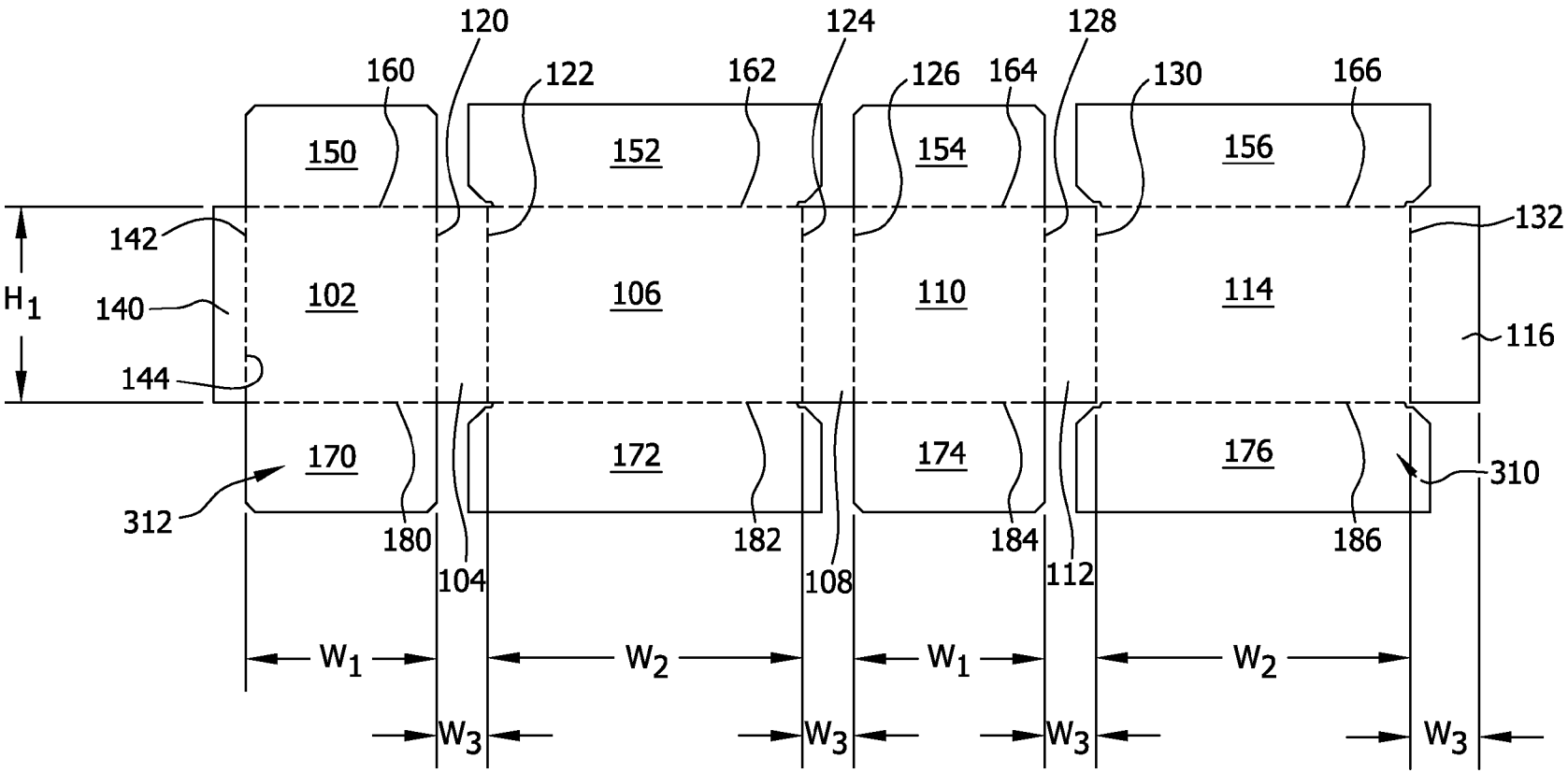
FIG. 1 is a view of a blank that may be used to form an octagonal container according to one embodiment of this invention.

In one aspect, a machine is provided for erecting an octagonal container from a knocked-down flat container. The knocked-down flat container is formed from a blank of sheet material. The container includes four main side panels and four corner panels extending between each of the main side panels. The container also includes a plurality of bottom flaps extending from the main side panels for forming a bottom of the container, and includes a plurality of top flaps extending from the main side panels for forming a top of the container.

The machine includes a body, a first erecting mechanism coupled to the body, a gluing mechanism, and a second erecting mechanism coupled to the body. The first erecting mechanism is configured to receive the knocked-down flat container and erect the knocked-down flat container into a container having a rectangular configuration. The first erecting mechanism includes a first erecting arm rotatably coupled to the body having at least one suction cup attached thereto, and a lower holding mechanism. The lower holding mechanism is configured to hold a lower side panel of the knocked-down flat container while the first erecting arm couples the suction cup to an upper side panel of the knocked-down flat container and rotates a portion of the knocked-down flat container into the rectangular configuration, also known as the partially erected container.

The partially erected container is then transferred in the rectangular configuration proximate the gluing mechanism to the second erecting mechanism. The second erecting mechanism includes at least one upper suction cup for attaching to an upper side panel of the partially erected container in the rectangular configuration, and at least one lower suction cup for attaching to a lower side panel of the partially erected container in the rectangular configuration. The at least one upper suction cup and the at least one lower suction cup move the upper side panel and the lower side panel apart in opposite directions, such that a leading side panel and a trailing side panel of the partially erected container move toward one another to form the octagonal container, also known as the fully erected container. The second erecting mechanism also includes at least one miter bar that is configured to position the corner panels of the octagonal container, and a pressing plate for pressing the glued bottom flaps together for forming the bottom of the octagonal container.

In another aspect, a method is provided for erecting an octagonal container from a knocked-down flat container. The knocked-down flat container is formed from a blank of sheet material. The container includes four main side panels and four corner panels extending between each of the main side panels. The container also includes a plurality of bottom flaps each extending from each of the main side panels for forming a bottom of the container, and includes a plurality of top flaps extending from the main side panels for forming a top of the container. The octagonal container is formed by a machine that includes a body, a first erecting mechanism coupled to the body, a gluing mechanism, and a second erecting mechanism coupled to the body. The method includes receiving the knocked-down flat container at the first erecting mechanism and erecting the knocked-down flat container into a container having a rectangular configuration, also known as the partially erected container.

Specifically, a lower holding mechanism of the first erecting mechanism holds a lower side panel of the knocked-down flat container while a first erecting arm of the first erecting mechanism couples a suction cup to an upper side panel of the knocked-down flat container and rotates a portion of the knocked-down flat container into the rectangular configuration. The partially erected container is transferred in the rectangular configuration proximate the gluing mechanism for applying glue and then to the second erecting mechanism. The method includes attaching at least one upper suction cup and the at least one lower suction cup to the upper side panel and the lower side panel, respectively, of the partially erected container, and moving the upper side panel and the lower side panel apart in opposite directions, such that a leading side panel and a trailing side panel of the partially erected container move toward one another to form the octagonal container, also known as the fully erected container. The method also includes positioning the corner panels of the octagonal container using at least one miter bar of the second erecting mechanism, and applying a pressing plate for pressing the glued bottom flaps together for forming the bottom of the octagonal container.

Figure 2:
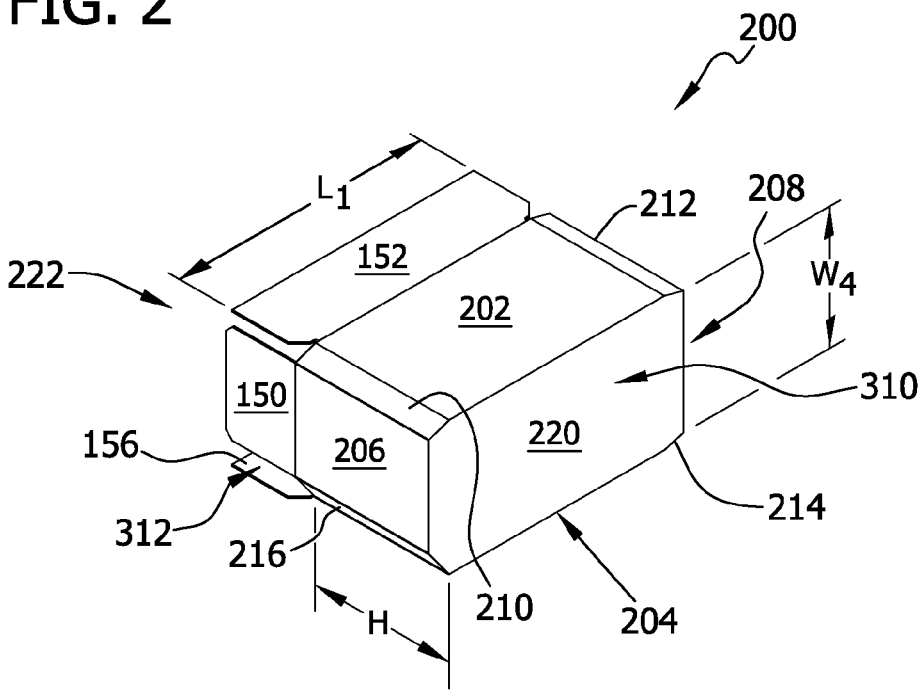
FIG. 2 is a view of an octagonal container that is formed by the blank shown in FIG. 1.

FIG. 1 is a view of a blank that may be used to form an octagonal container according to one embodiment of this invention. FIG. 2 is a view of an octagonal container that is formed by the blank shown in FIG. 1. Although, the present invention is described with respect to a blank for forming an octagonal container, as would be appreciated by one of ordinary skill in the art, the present invention, with modification, may also apply to a blank for forming any polygonal-shaped container. In the exemplary embodiment, blank 100 is fabricated from at least one of paperboard, cardboard, corrugated board, and/or plastic. Blank 100 has an exterior surface 310 and an interior surface 312 and includes eight aligned rectangular panels 102, 104, 106, 108, 110, 112, 114, and 116, joined together by preformed parallel fold lines 120, 122, 124, 126, 128, 130, and 132. Specifically, panels 102 and 104 are connected along fold line 120; panels 104 and 106 are connected along fold line 122; panels 106 and 108 are connected along fold line 124; panels 108 and 110 are connected along fold line 126; panels 110 and 112 are connected along fold line 128; panels 112 and 114 are connected along fold line 130; and panels 114 and 116 are connected along fold line 132. A tongue 140 is connected along a free edge 142 of panel 102 by a fold line 144 that is parallel to fold lines 120, 122, 124, 126, 128, 130, and 132.

Furthermore, each panel 102, 106, 110, and 114 includes a top flap 150, 152, 154, and 156, respectively. Specifically, top flap 150 is connected to panel 102 by a fold line 160; top flap 152 is connected to panel 106 by a fold line 162; top flap 154 is connected to panel 110 by a fold line 164; and top flap 156 is connected to panel 114 by a fold line 166. Fold lines 160, 162, 164, and 166 are aligned perpendicular to fold lines 120, 122, 124, 126, 128, 130, 132, and 144. Similarly, each panel 102, 106, 110, and 114 includes a bottom flap 170, 172, 174, and 176, respectively. Specifically, bottom flap 170 is connected to panel 102 by a fold line 180; bottom flap 172 is connected to panel 106 by a fold line 182; bottom flap 174 is connected to panel 110 by a fold line 184; and bottom flap 176 is connected to panel 114 by a fold line 186. Fold lines 180, 182, 184, and 186 are aligned perpendicular to fold lines 120, 122, 124, 126, 128, 130, 132, and 144.

In the exemplary embodiment, rectangular panels 102, 104, 106, 108, 110, 112, 114, and 116 and tongue 140 each have the same height $H_1$. Panels 102 and 110 each have a width $W_1$. Panels 106 and 114 each have a width $W_2$ that is greater than width $W_1$. Panels 104, 108, 112, and 116 each have a $W_3$ that is less than width $W_1$.

Blank 100 is configured to form, by wrapping and fastening panels 102, 104, 106, 108, 110, 112, 114, and 116, tongue 140, and flaps 150, 152, 154, 156, 170, 172, 174, and 176, as described below, a container 200, as shown in FIG. 2. Container 200 has a height equal to height $H_1$, a length $L_1$ and a width $W_4$. Container 200 has a rectangular cross section and four cut corners. In the exemplary embodiment, the large lateral faces 202 and 204 of container 200 are formed by panels 106 and 114, respectively, whereas the small lateral faces 206 and 208 are formed by panels 102 and 110, respectively. Further, panels 104, 108, 112, and 116 form the cut corners 210, 212, 214, and 216 of container 200. Moreover, bottom flaps 170, 172, 174, and 176 form the bottom 220 of container 200; and top flaps 150, 152, 154, and 156 form the top 222 of container 200.

Figure 3:
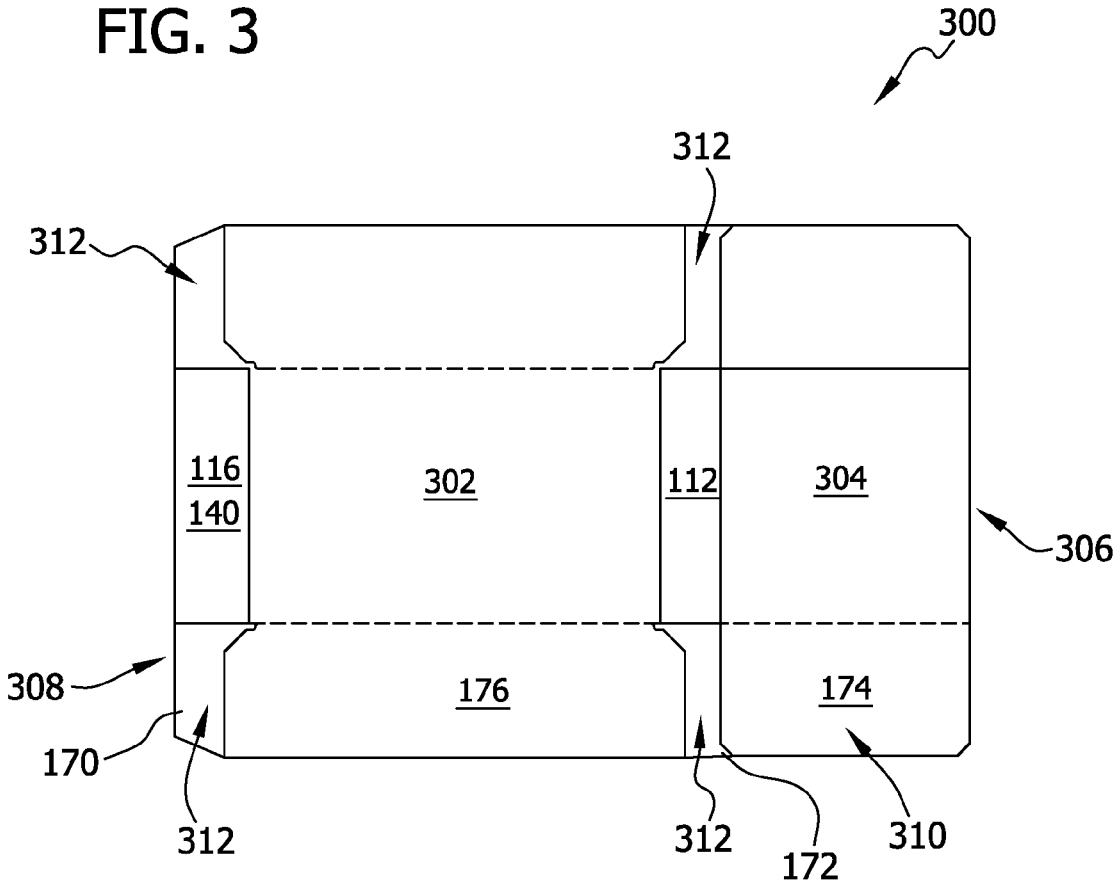
FIG. 3 is a view of a knocked-down flat container formed from the blank shown in FIG. 1 and configured to form the container shown in FIG. 2.

FIG. 3 is a view of a knocked-down flat container 300 formed from blank 100 and configured to form container 200. Knocked-down flat container 300 is formed by folding panel 102 into a face-to face relationship with at least a portion of panel 106, and folding at least a portion of panel 114 into a face-to-face relationship with panel 110. Accordingly, panel 114 forms an upper side panel 302 of knocked-down flat container 300 and panel 102 forms a leading panel 304 of knocked-down flat container 300. Further, panel 106 forms a lower side panel 306 of knocked-down flat container 300 and panel 110 forms a trailing panel 308 of knocked-down flat container 300. Knocked-down flat container 300 has exterior surface 310 of blank 100 exposed, and a minimal area of interior surface 312 exposed.

Figure 4:
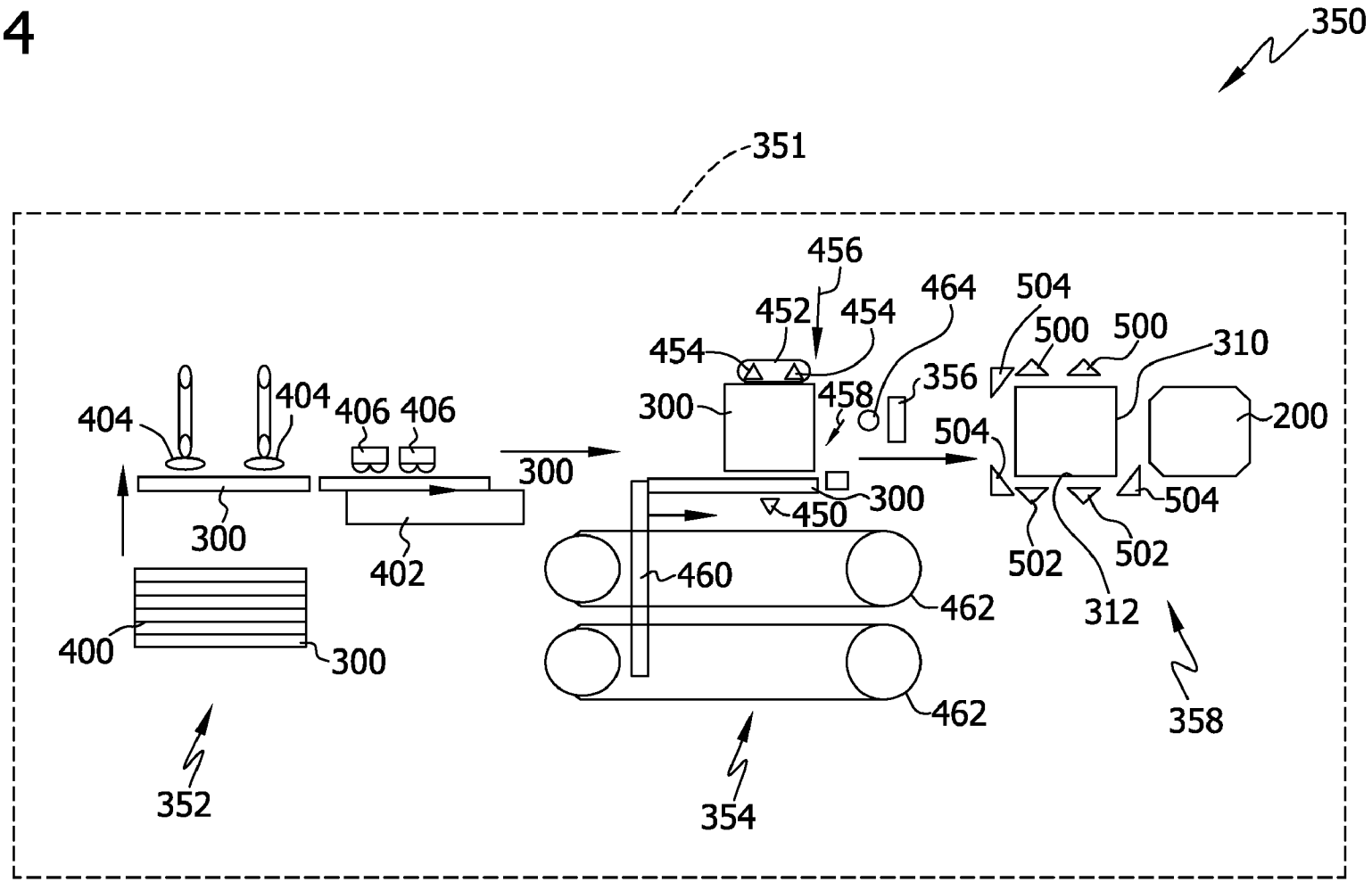
FIG. 4 is a schematic view of a machine that is used to form the octagonal container shown in FIG. 2 from the knocked-down flat container shown in FIG. 3.

FIG. 4 is a schematic view of a machine 350 that may be used to form container 200 from knocked-down flat container 300. Although, the present invention is described with respect to a machine for forming an octagonal container, as would be appreciated by one of ordinary skill in the art, the present invention, with modification, may also apply to a machine for forming any polygonal-shaped container. For example, a polygonal container formed by machine 350 may includes zero, one, two, or three corners to form a four, five, six, or seven-sided container. Machine 350 includes a body 351, a feeding mechanism or assembly 352, a first erecting mechanism or assembly 354, a glue mechanism or assembly 356, and a second erecting mechanism or assembly 358. Feeding mechanism 352, first erecting mechanism 354, glue mechanism 356, and second erecting mechanism 358 are each coupled to machine body 351. Exemplary means for erecting the knocked-down flat container into a partially erect container having a substantially rectangular configuration include, for example, first erecting mechanism 354, although any suitable means for erecting may be used. Exemplary means for further erecting the partially erected container into a polygonal container include, for example, second erecting mechanism 358, although any suitable means for further erecting may be used. Exemplary means for applying adhesive include, for example, glue mechanism 356, although any suitable means for applying adhesive may be used.

A plurality of knocked-down flats 300 are placed in a stack 400 adjacent feeding mechanism 352. Specifically, the knocked-down flats 300 are positioned such that the leading panel 304 (shown in FIG. 3) is positioned adjacent a feed band 402 of feeding mechanism 352.

Feeding mechanism 352 includes at least one suction cup 404 that is configured to remove a top knocked-down flat container 300 from stack 400. Specifically, suction cup 404 attaches to upper side panel 302 (shown in FIG. 3) and moves knocked-down flat container 300 to feed band 402. The lower side panel 306 (shown in FIG. 3) of knocked-down flat container 300 is positioned on feed band 402, and at least one feed roll 406 is positioned in contact with leading panel 304 and upper side panel 302. Feed roll 406 and feed band 402 move knocked-down flat container 300 to first erecting mechanism 354.

Figure 5:
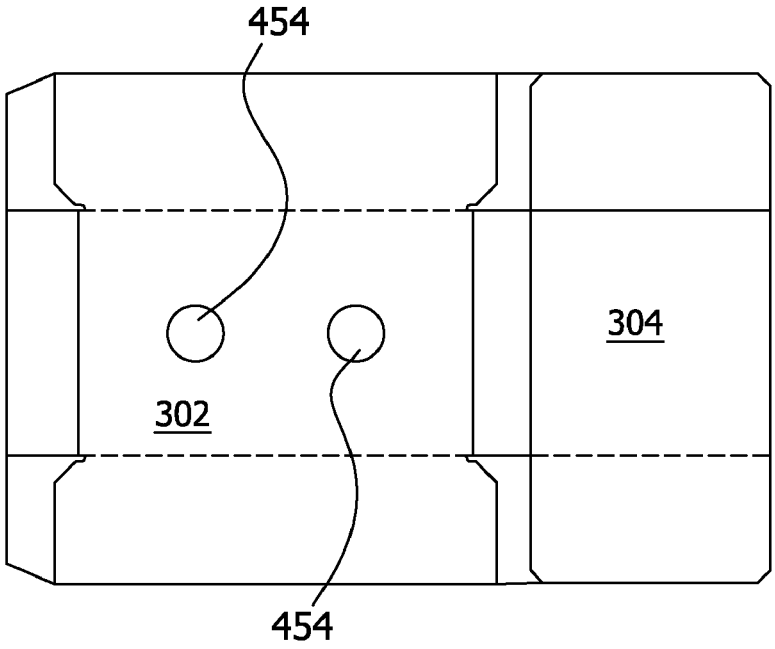
FIG. 5 is a view of a pair of suction cups shown in FIG. 4 attached to the knocked-down flat container shown in FIG. 3.
Figure 6:
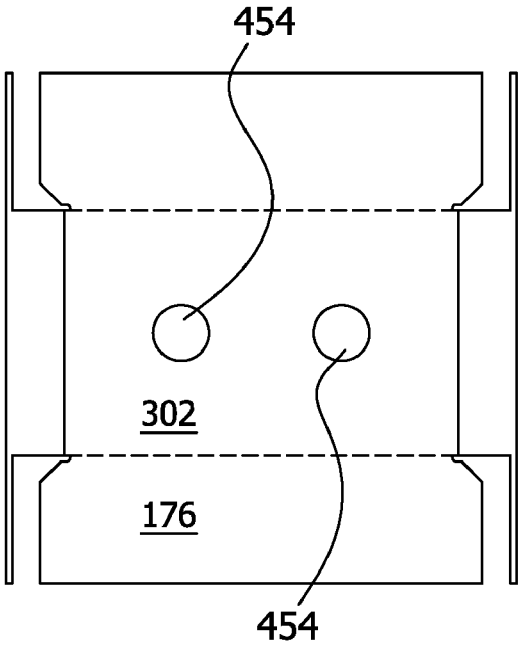
FIG. 6 is a view of the suction cups shown in FIG. 5 attached to the rectangular configuration of the knocked-down flat container shown in FIG. 3.

First erecting mechanism 354 includes a lower holding mechanism or assembly 450 that locks to lower side panel 306 of knocked-down flat container 300. In the exemplary embodiment, lower holding mechanism 450 is a vacuum that locks to lower side panel 306 via suction. First erecting mechanism 354 also includes a rotatable erector arm 452 that includes at least one suction cup 454 that attaches to upper side panel 302 of knocked-down flat container 300, as shown in FIG. 5. Erector arm 452 rotates such that knocked-down flat container 300 is formed into a partially erected container having a substantially rectangular configuration. FIG. 6 is a top view of knocked-down flat container 300 partially erected into the rectangular configuration and having a pair of suction cups 454 attached thereto. Exemplary means for holding a lower side panel of the knocked-down flat container include, for example, lower holding mechanism 450, although any suitable means for holding may be used. Further, exemplary means for attaching to an upper side panel of the knocked-down flat container include, for example, erector arm 452 and/or suction cup 454, although any suitable means for attaching may be used.

Figure 7:
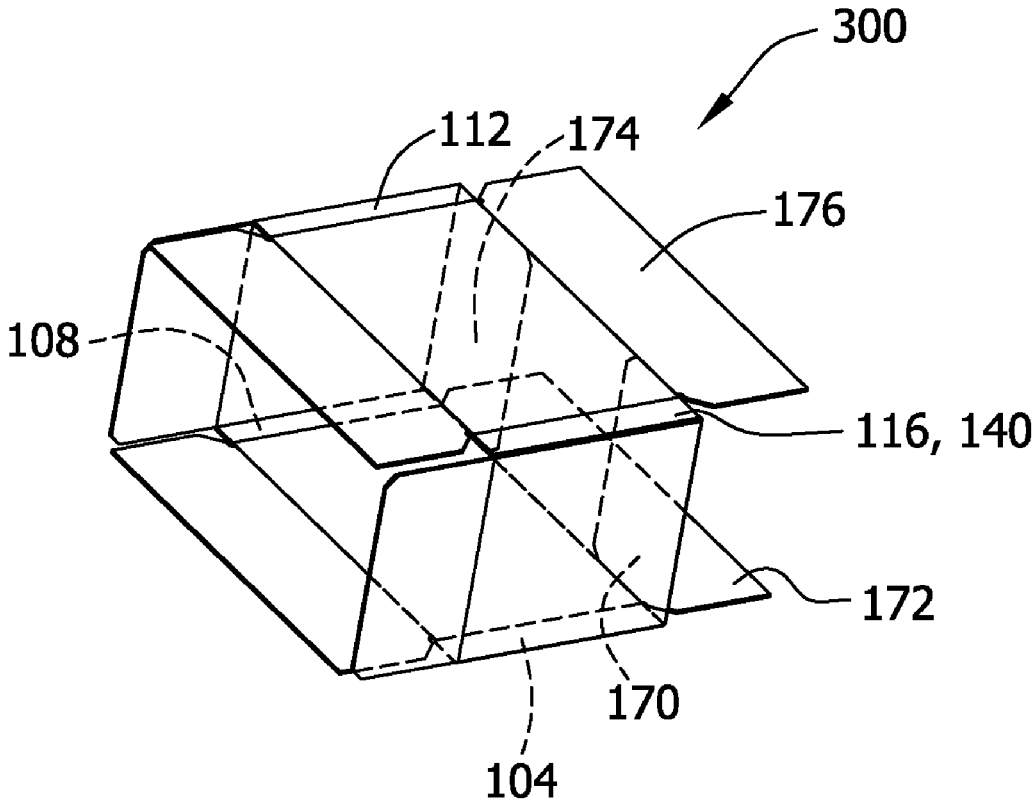
FIG. 7 is a perspective view of the knocked-down flat container erected into a rectangular configuration at a first erecting mechanism shown in FIG. 4.
Figure 8:
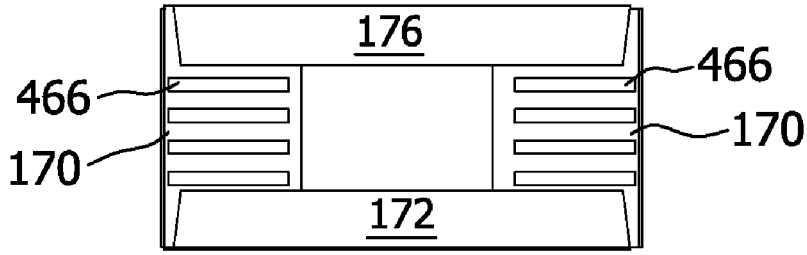
FIG. 8 is a view of a bottom of the container in the rectangular configuration shown in FIG. 7 having hot melt applied thereto.

Referring again to FIG. 4, after knocked-down flat container 300 is formed into the partially erected container, bottom flaps 170 (shown in FIG. 1) and 174 (shown in FIG. 1) are folded with a first folding arm 456 to a substantially ninety degree angle with respect to leading panel 304 and trailing panel 308 as shown in FIG. 7. Further, a second folding arm 458 folds bottom flaps 172 (shown in FIG. 1) and 176 (shown in FIG. 1) to a substantially 45 degree angle with respect to upper side panel 302 and lower side panels 306. First erecting mechanism 354 also includes a walking stick 460 that is moved along a pulley system 462 to move knocked-down flat container 300 in the partially erected, rectangular configuration to second erecting mechanism 358. As partially erected, knocked-down flat container 300 is moved toward second erecting mechanism 358 a position of knocked-down flat container 300 is detected by a photoeye 464. As shown in FIG. 8, when partially erected, knocked-down flat container 300 reaches a predetermined position gluing mechanism 356 applies hot melt 466 to bottom flaps 170 and 174. Exemplary means for folding a first pair of opposing bottom flaps include, for example, first folding arm 456, although any suitable means for folding may be used. Further, exemplary means for folding a second pair of opposing bottom flaps include, for example, second folding arm 458, although any suitable means for folding may be used.

Figure 9:
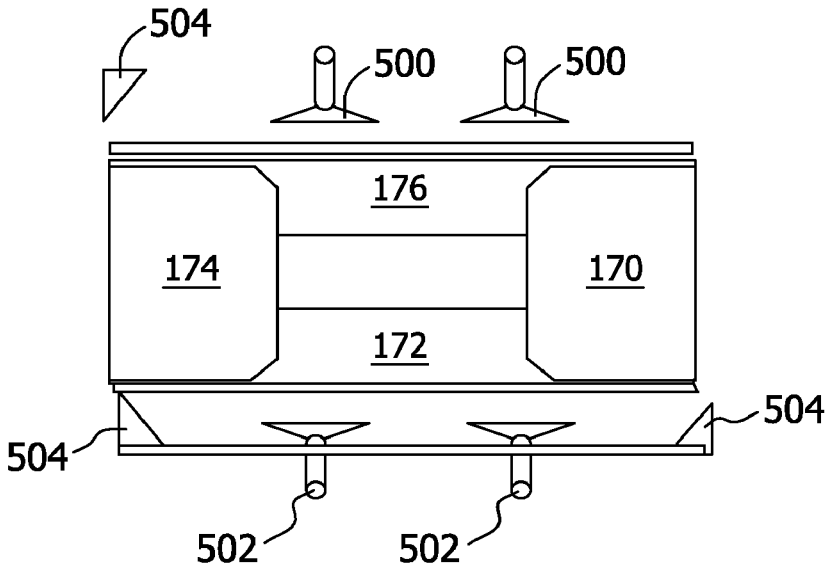
FIG. 9 is a schematic side view of the container in the rectangular configuration shown in FIGS. 7 and 8 positioned within the second erecting mechanism shown in FIG. 4.

FIG. 9 is a schematic side view of knocked-down flat container 300 in the partially erected, substantially rectangular configuration shown in FIGS. 7 and 8 positioned within the second erecting mechanism shown in FIG. 4. Referring to FIGS. 4 and 9, second erecting mechanism 358 includes at least one upper suction cup 500 and at least one lower suction cup 502. Second erecting mechanism 358 also includes at least one fixed miter 504 positioned at a corner of the rectangular configuration of knocked-down flat container 300. Upper suction cup 500 is configured to attach to upper side panel 302, and lower suction cup 502 is configured to attach to lower side panel 306. Exemplary means for means for attaching to an upper side panel of the partially erected container in the substantially rectangular configuration include, for example, upper suction cup 500, although any suitable means for attaching may be used. Further, exemplary means for attaching to a lower side panel of the partially erected container in the substantially rectangular configuration include, for example, lower suction cup 502, although any suitable means for attaching may be used.

Figure 10:
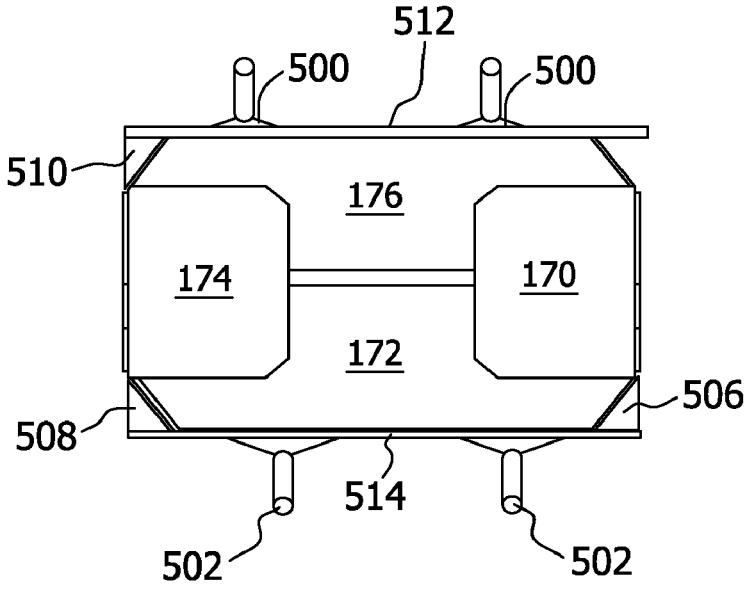
FIG. 10 is a schematic side view of the orthogonal container shown in FIG. 2 being formed at the second erecting mechanism shown in FIG. 4.

As seen in FIG. 10, suction cups 500 and 502 pull upper side panel 302 and lower side panel 306 apart in opposite directions, such that leading panel 304 and trailing panel 308 are pulled toward on another to form octagonal container 200. Further, panels 104, 108, 112, and 116 are repositioned at an angle to form the corners 210, 212, 214, and 216 of container 200. The formation of corners 210, 212, 214, and 216 is aided by at least one fixed miter 504. More specifically, fixed miter 504 applies a force and/or a pressure to exterior surface 310 of a respective corner 210, 212, 214, and/or 216 when partially erected, knocked-down flat container 300 is positioned against miter 504. Accordingly, miter 504 facilitates erecting container 200 from partially erected, knocked-down flat container 300 by applying pressure to exterior surface 310 of container 300, and more specifically, exterior surface 310 of a corner 210, 212, 214, or 216.

In the exemplary embodiment, as shown in FIG. 10, second erecting mechanism 358 includes a first bottom fixed miter 506, a second bottom fixed miter 508, and a top fixed miter 510. In the exemplary embodiment, first bottom fixed miter 506 positions panel 104 to form corner 210, second bottom fixed miter 508 positions panel 108 to form corner 212, and top fixed miter 510 positions panel 112 to form corner 214. In an alternative embodiment, second erecting mechanism 358 may be modified to include any suitable number of fixed miters 504 capable of forming container corners, as described herein. Further, second erecting mechanism 358 includes a top plate 512 that positions panel 114/upper side panel 302, and a bottom plate 514 that positions panel 106/lower side panel 306. Moreover, in the exemplary embodiment, panel 116 forms corner 216 by virtue of the positioning of panels 104, 106, 108, 112, and 114. Miter bar 504 is an example of a means for applying a force to the exterior surface of at least one corner panel, although any suitable means for applying a force may be used.

Figure 11:
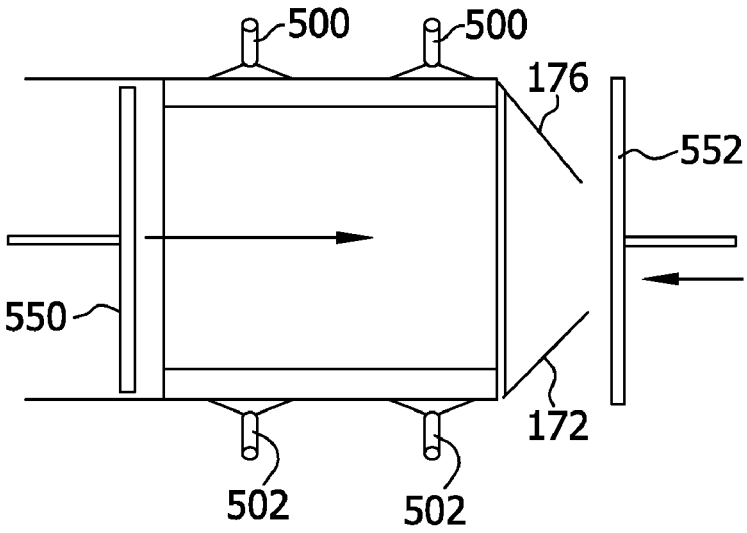
FIG. 11 is another schematic side view of the orthogonal container shown in FIG. 2 being formed at the second erecting mechanism shown in FIG. 4.

FIG. 11 is a side view of octagonal container 200 at second erecting mechanism 358. As illustrated in FIG. 11, after octagonal container 200 is formed, bottom flaps 172 and 176 are still positioned at a 45 degree angle with respect to upper side panel 302 and lower side panels 306. Further, bottom flaps 170 and 174 are positioned at a substantially ninety degree angle with respect to leading panel 304 and trailing panel 308. Moreover, panels 170 and 174 have hot melt 466 (shown in FIG. 8) applied thereon, as described above. In the exemplary embodiment, second erecting mechanism 358 includes a compression plate 550 and a backing plate 552 that are configured to seal flaps 172 and 176 to flaps 170 and 174. In the exemplary embodiment, compression plate 550 and backing plate 552 are driven by at least one of a servo mechanism, a pneumatic mechanism, a hydraulic mechanism, a computer, and/or any other suitable mechanism or assembly capable of driving compression plate 550 and backing plate 552, as described herein. Exemplary means for applying a force to an exterior surface of the bottom flaps include, for example, backing plate 552, although any suitable means for applying a force may be used. Further, exemplary means for applying a force to an interior surface of the bottom flaps include, for example, compression plate 550, although any suitable means for applying a force may be used.

Figure 12:
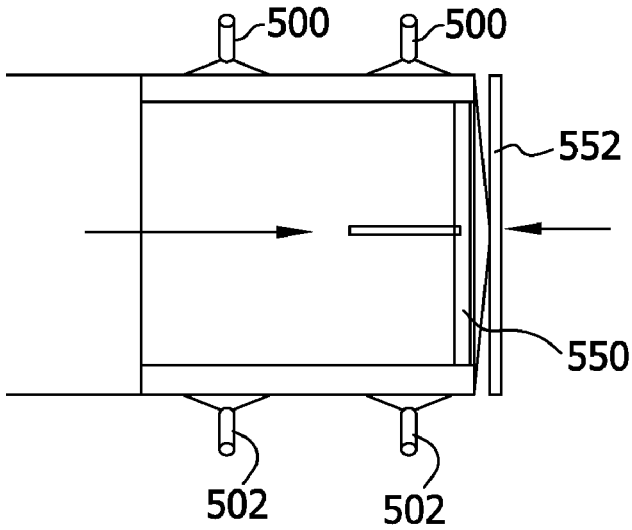
FIG. 12 is a further schematic side view of the orthogonal container shown in FIG. 2 being formed at the second erecting mechanism shown in FIG. 4.
Figure 13:
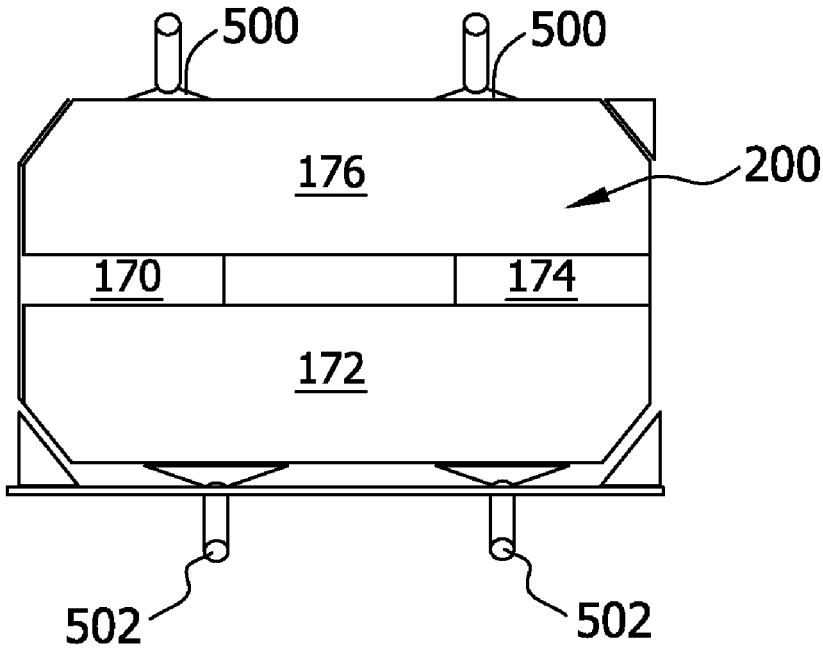
FIG. 13 is a schematic side view of the orthogonal container shown in FIG. 2 positioned within the second erecting mechanism shown in FIG. 4.

As seen in FIG. 12, compression plate 550 moves through octagonal container 200 and toward backing plate 552. Compression plate 550 is positioned substantially flush with bottom flaps 170 and 174. Backing plate 552 moves toward compression plate 550 and is positioned substantially flush against bottom flaps 172 and 176. As plate 550 moves toward plate 552, backing plate 552 applies a force and/or pressure to exterior surface 310 of bottom flaps 170, 172, 174, and/or 176, and compression plate 552 applies a force and/or pressure to interior surface 312 of bottom flaps 170, 172, 174, and/or 176. Accordingly, the movement of compression plate 550 and backing plate 552 compresses flaps 170 and 174 against flaps 172 and 176 thereby, sealing the bottom 220 of container 200 by virtue of the hot melt 466. FIG. 13 is a view of the bottom 220 of container 200 after being fully erected at second erecting mechanism 358. After being fully erected, octagonal container 200 is discharged from machine 350 and a second knocked-down flat container 300 is fed through machine 350, as described herein.

Figure 14:
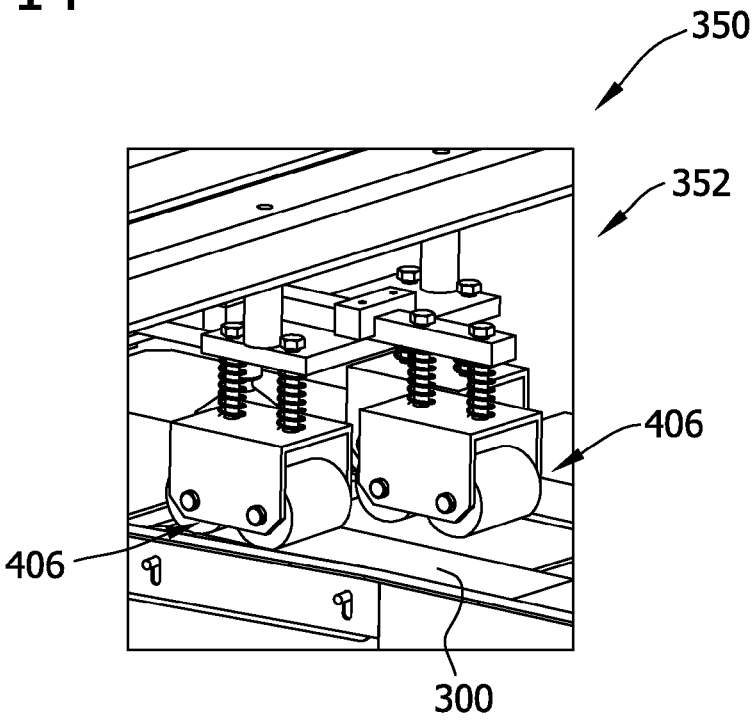
FIG. 14 is a perspective view of the feed rolls shown in FIG. 4.
Figure 15:
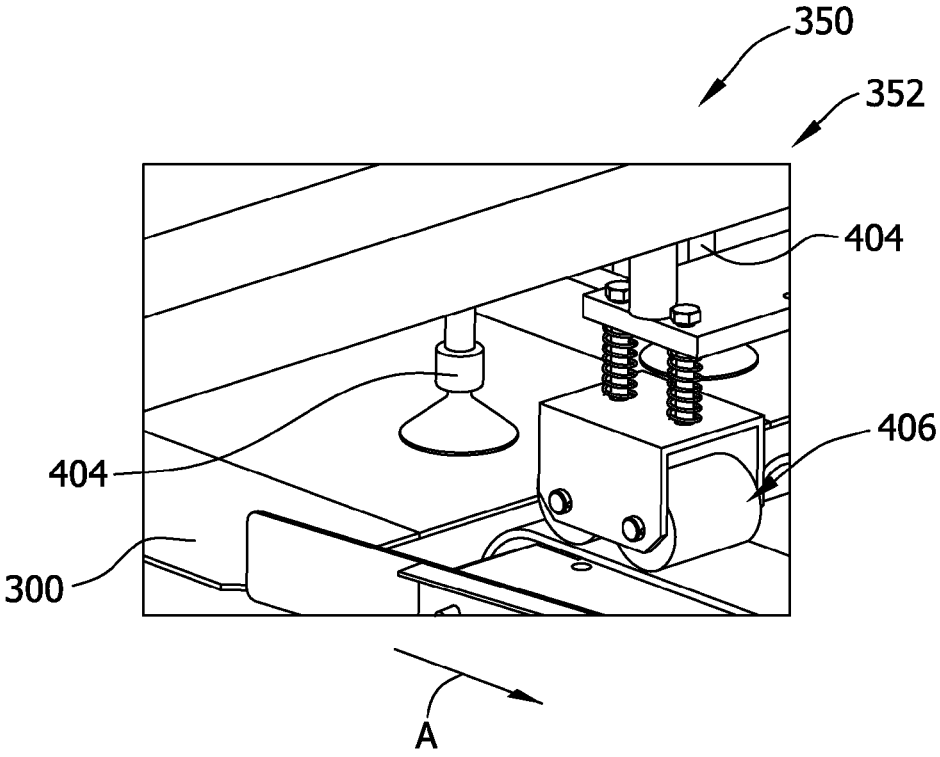
FIG. 15 is a perspective view of the suction cups shown in FIG. 4 feeding the knocked-down flat container shown in FIG. 3 to the feed rolls shown in FIG. 4.
Figure 16:
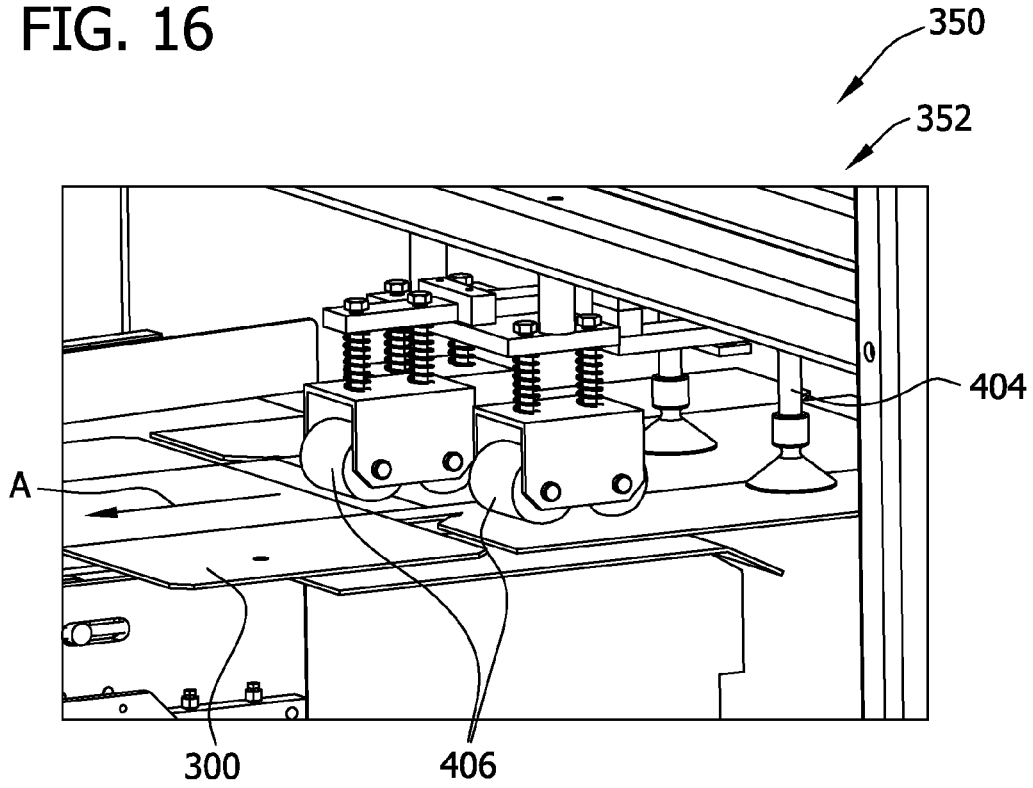
FIG. 16 is a perspective view of the feed rolls shown in FIG. 4 moving the knocked-down flat container shown in FIG. 3 to the first erecting mechanism shown in FIG. 4.

FIGS. 14-41 are views of a knocked-down flat container 300 being formed into an octagonal container 200 using machine 350 shown in FIG. 4. An arrow A indicates the direction of movement of container 300 and/or 200 through machine 350. More specifically, FIGS. 14-16 show knocked-down flat container 300 being feed into the machine 350 by the feeding mechanism 352. FIG. 14 shows the feed rolls 406 of the feeding mechanism 352. FIG. 15 shows the suction cups 404 of the feeding mechanism 352 feeding the knocked-down flat container 300 to the feed rolls 406 of the feeding mechanism 352. FIG. 16 shows the feed rolls 406 of the feeding mechanism 352 moving the knocked-down flat container 300.

Figure 17:
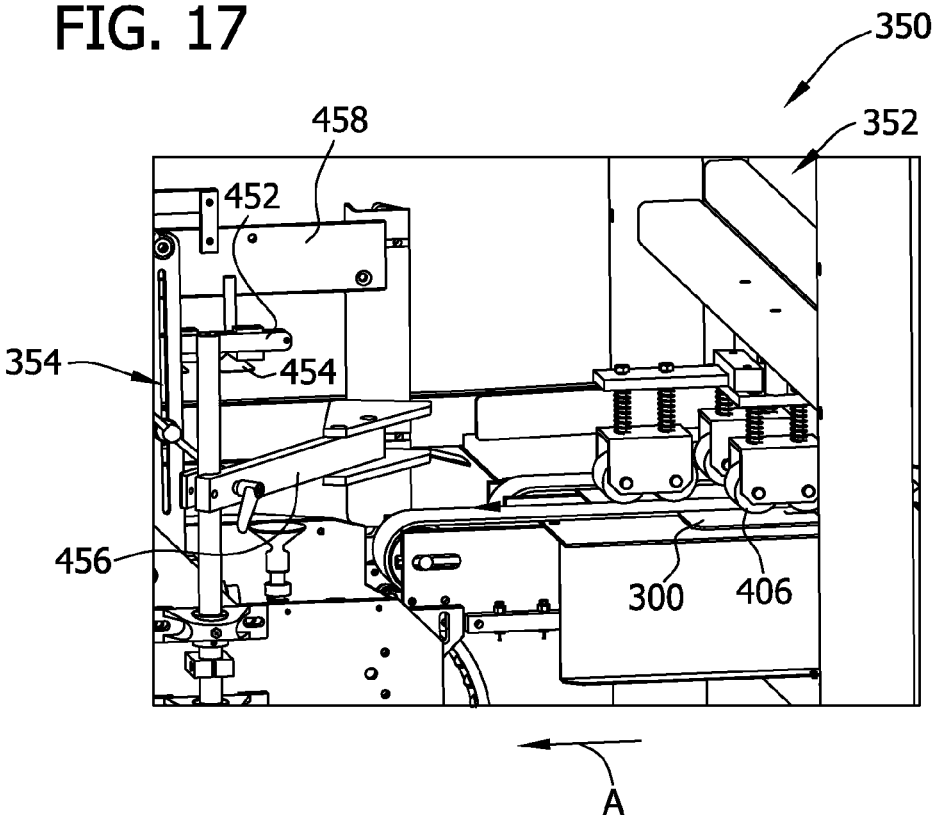
FIG. 17 is another perspective view of the feed rolls shown in FIG. 4 feeding the knocked-down flat container shown in FIG. 3 to the first erecting mechanism shown in FIG. 4.
Figure 18:
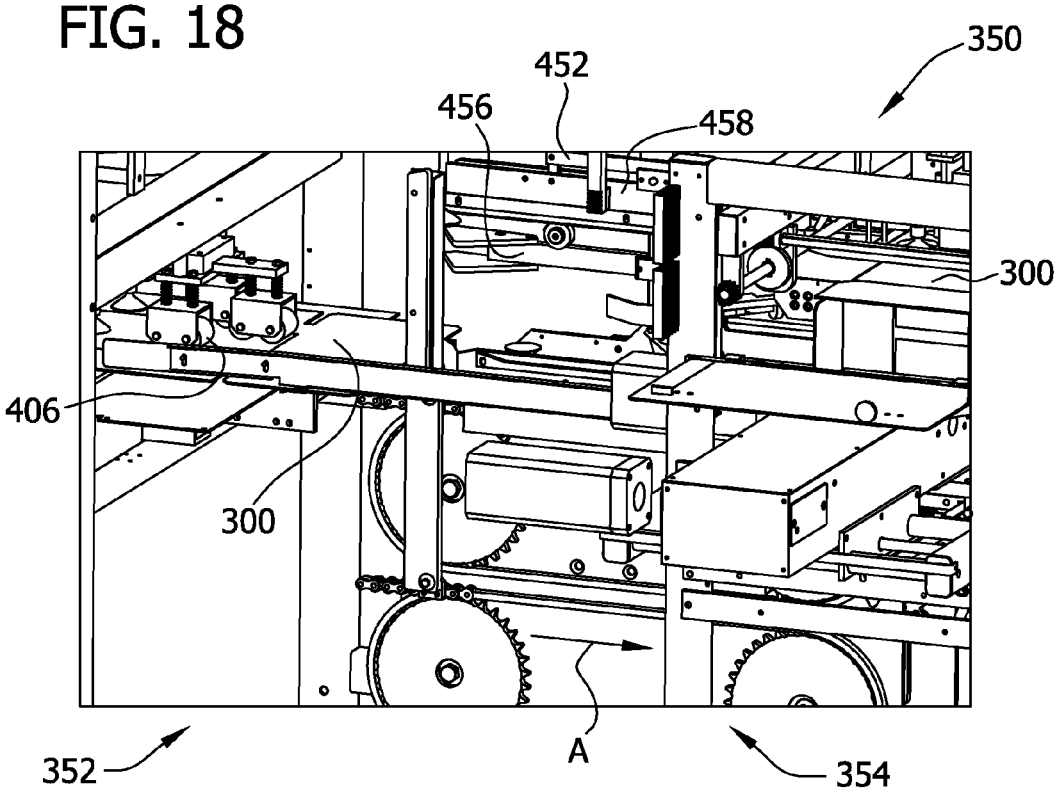
FIG. 18 is perspective view of the first erecting mechanism shown in FIG. 4 erecting a first knocked-down flat container shown in FIG. 3, and the feed rolls shown in FIG. 4 feeding a second knocked-down flat container to the first erecting mechanism.
Figure 19:
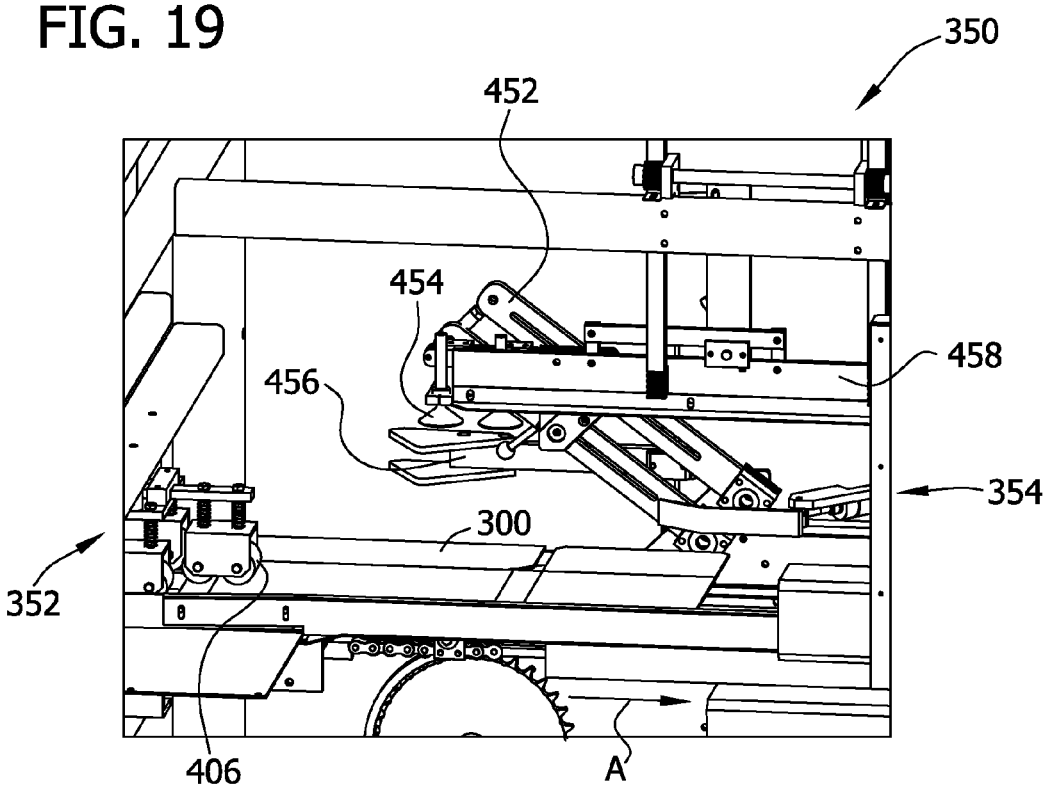
FIG. 19 is a perspective view of a knocked-down flat container shown in FIG. 3 being fed to the first erecting mechanism shown in FIG. 4.

FIGS. 17-19 show the feeding mechanism 352 feeding the knocked-down flat container 300 to the first erecting mechanism 354. FIG. 18 shows the first erecting mechanism 354 erecting a first knocked-down flat container 300 in a partially erected container 300, while the feed rolls 406 of the feeding mechanism 352 feed a second knocked-down flat container 300 to the first erecting mechanism 354.

Figure 20:
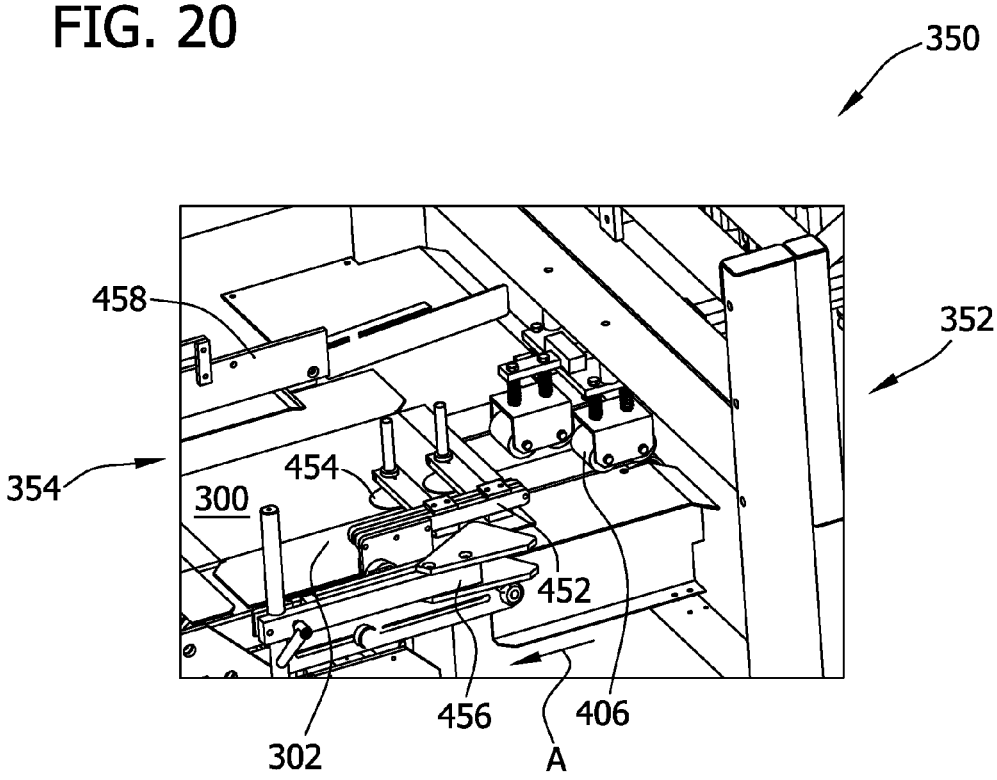
FIG. 20 is a perspective view of the suction cups shown in FIGS. 5 and 6 attaching to the knocked-down flat container shown in FIG. 3 at the first erecting mechanism shown in FIG. 4.
Figure 21:
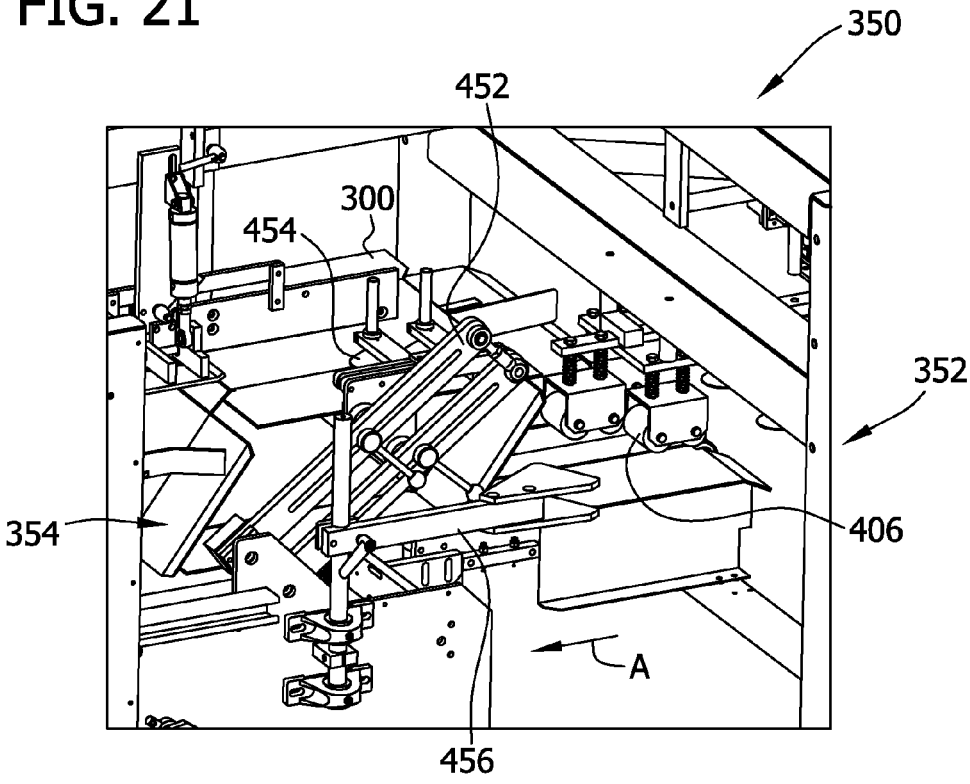
FIG. 21 is a perspective view of the first erecting mechanism shown in FIG. 4 erecting the knocked-down flat container shown in FIG. 3 into the rectangular configuration shown in FIG. 7.
Figure 22:
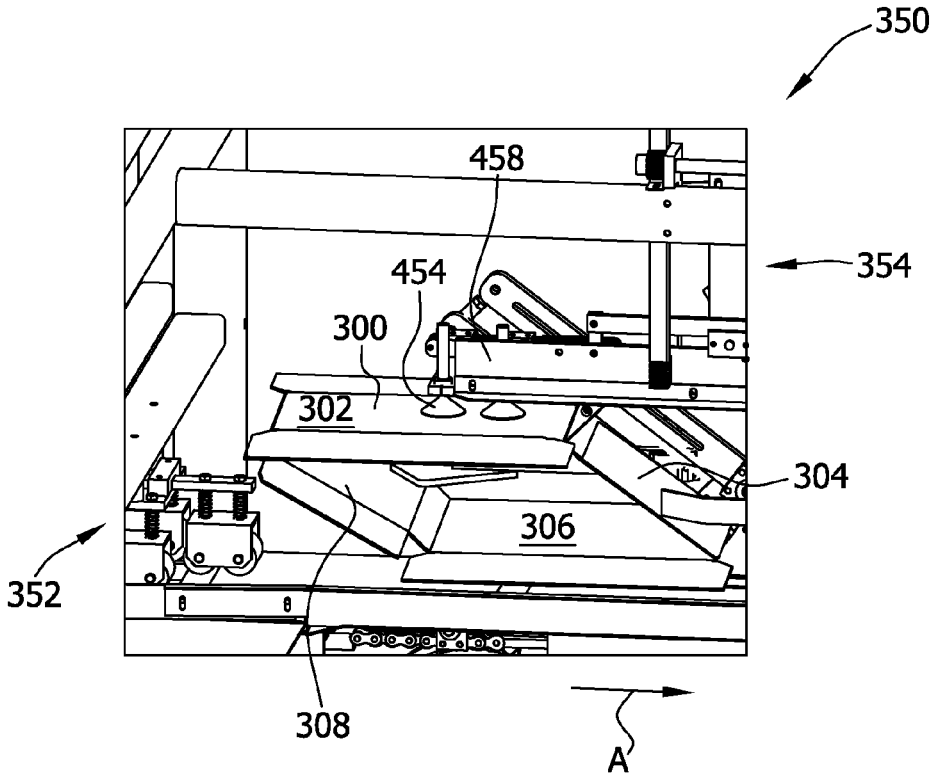
FIG. 22 is another perspective view of the first erecting mechanism shown in FIG. 4 erecting the knocked-down flat container shown in FIG. 3 into the rectangular configuration shown in FIG. 7.
Figure 23:
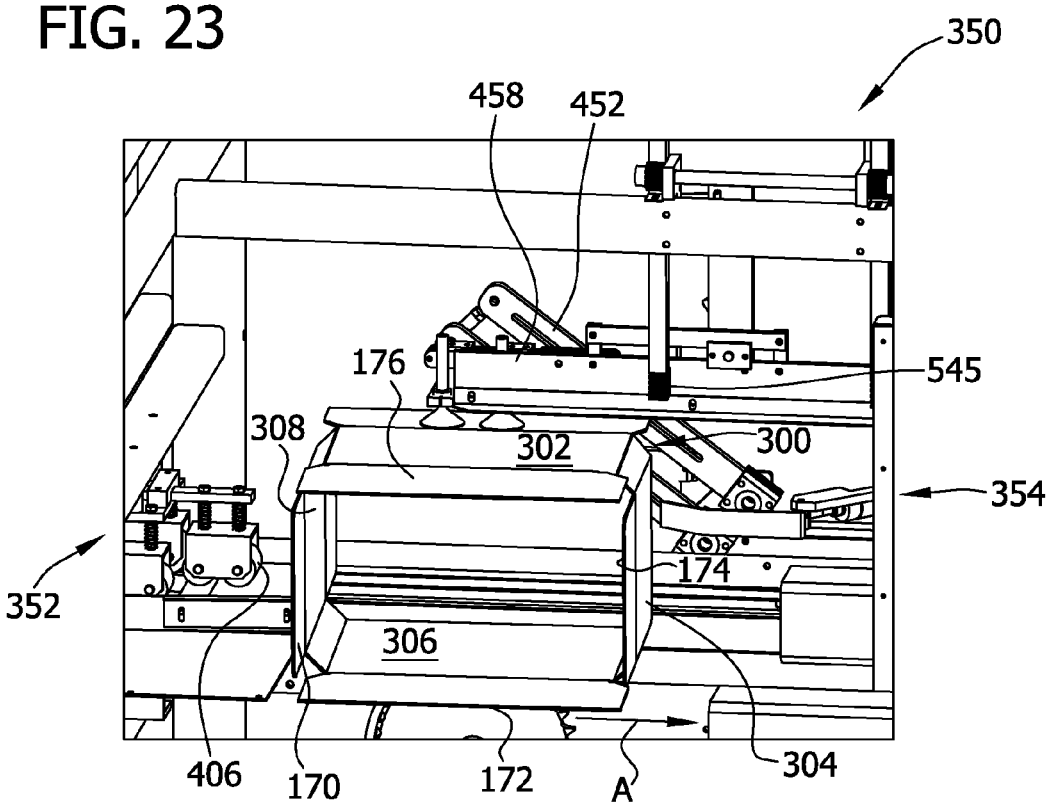
FIG. 23 is a perspective view of the knocked-down flat container in the rectangular configuration shown in FIG. 7 as formed by the first erecting mechanism shown in FIG. 4.
Figure 24:
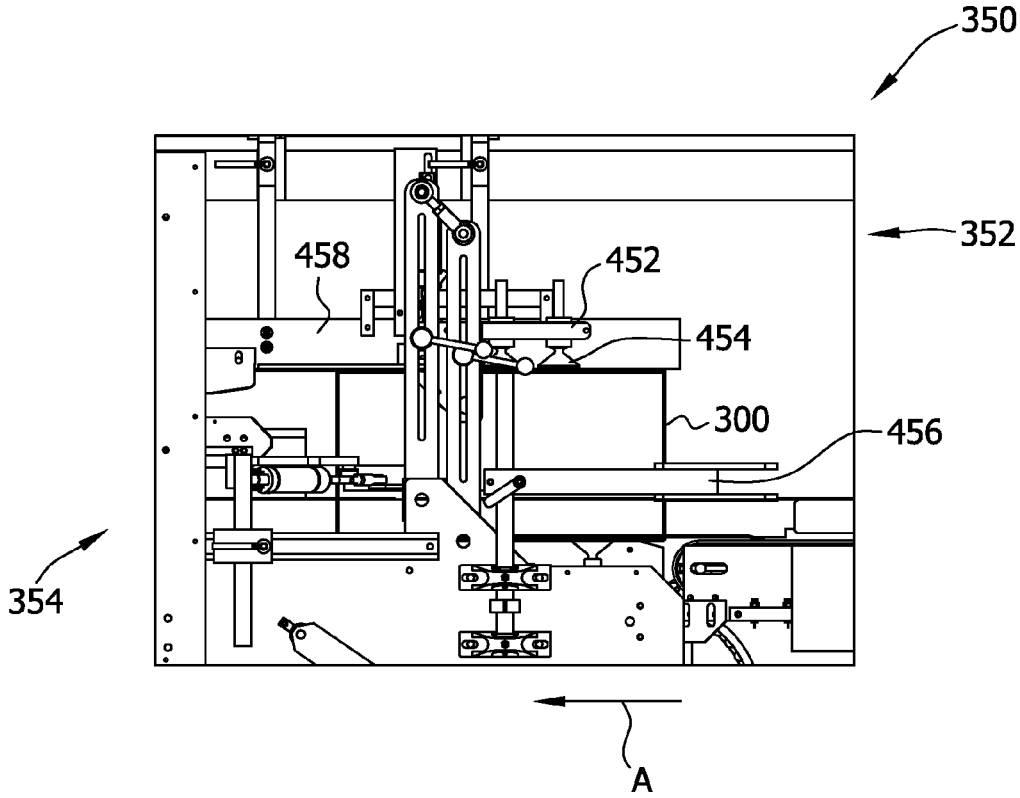
FIG. 24 is another perspective view of the knocked-down flat container in the rectangular configuration shown in FIG. 7 as formed by the first erecting mechanism shown in FIG. 4.
Figure 25:
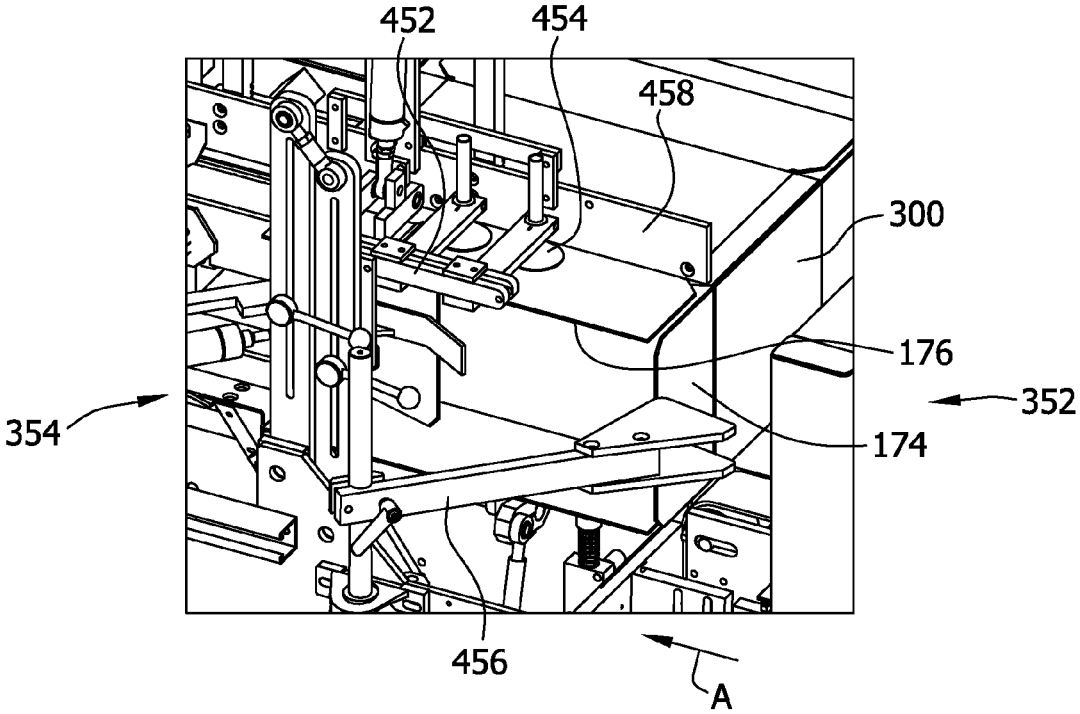
FIG. 25 is a perspective view of the first and second folding arms shown in FIG. 4 folding the bottom flaps of the knocked-down flat container in the rectangular configuration shown in FIG. 7.
Figure 26:
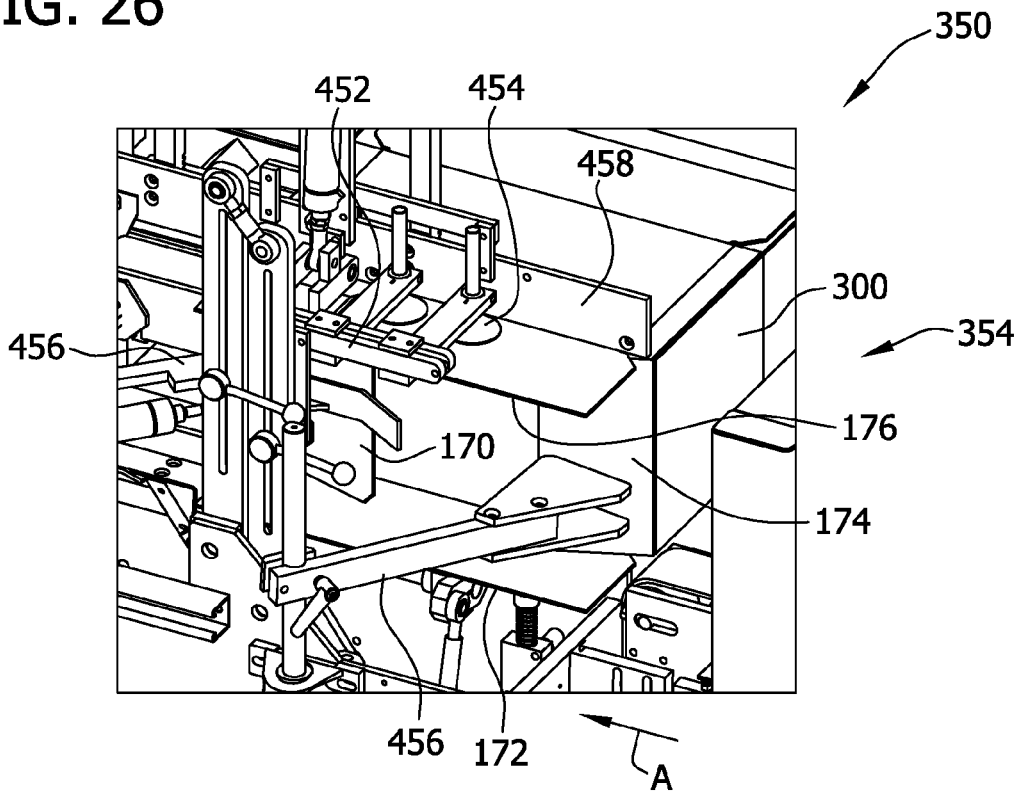
FIG. 26 is another perspective view of the first and second folding arms shown in FIG. 3 folding the bottom flaps of the knocked-down flat container in the rectangular configuration shown in FIG. 7.
Figure 27:
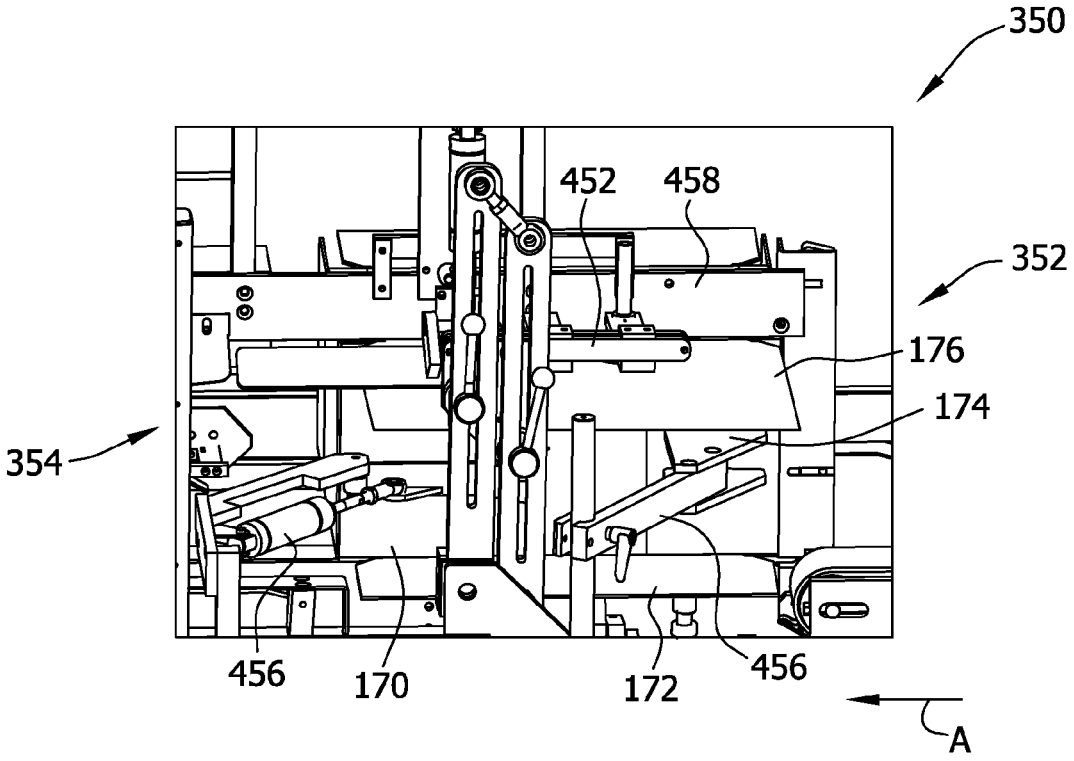
FIG. 27 is a further perspective view of the first and second folding arms shown in FIG. 3 folding the bottom flaps of the knocked-down flat container in the rectangular configuration shown in FIG. 7.
Figure 28:
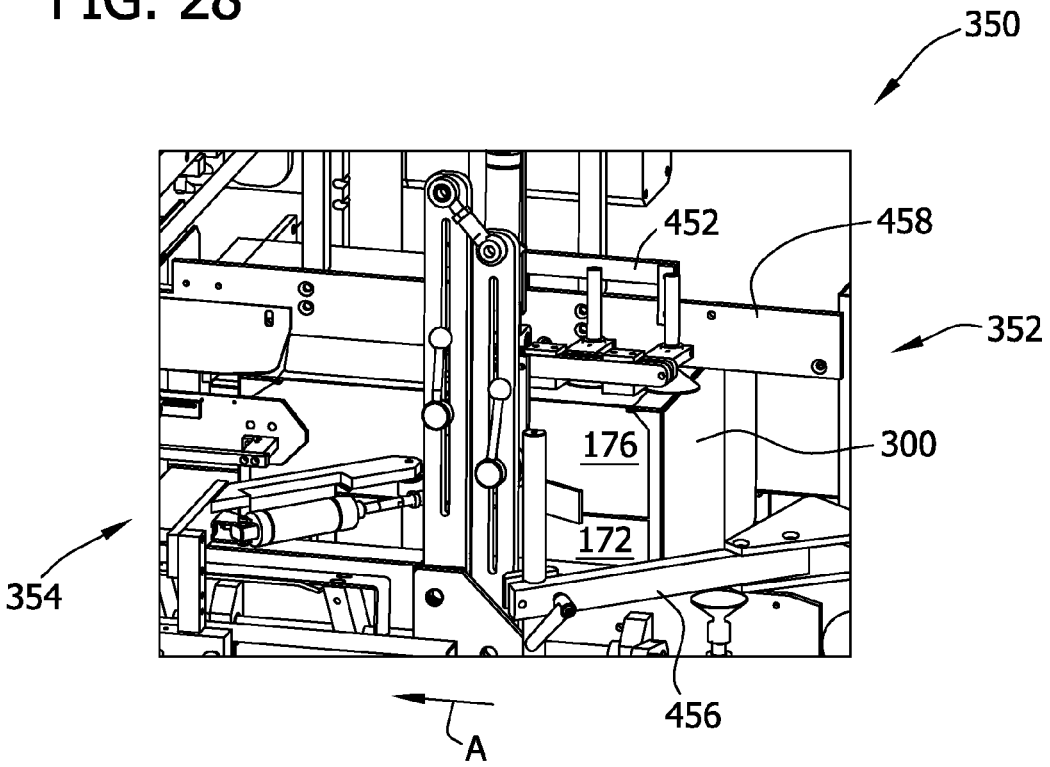
FIG. 28 is yet another perspective view of the first and second folding arms shown in FIG. 3 folding the bottom flaps of the knocked-down flat container in the rectangular configuration shown in FIG. 7.

FIGS. 20-24 show the knocked-down flat container 300 being erected into the partially erected container having a substantially rectangular configuration. FIG. 20 shows the suction cups 454 of the first erecting mechanism 354 attaching to the upper side panel 302 of the knocked-down flat container 300. FIGS. 21 and 22 show the first erecting mechanism 354 erecting the knocked-down flat container 300 into the partially erected container. FIGS. 23 and 24 show the rectangular configuration of the partially erected, knocked-down flat container 300 as formed by the first erecting mechanism 354.

FIGS. 25-28 show the first and second folding arms 456 and 458 of the first erecting mechanism 354 folding the bottom flaps 170, 172, 174, and 176 of the partially erected, knocked-down flat container 300.

Figure 29:
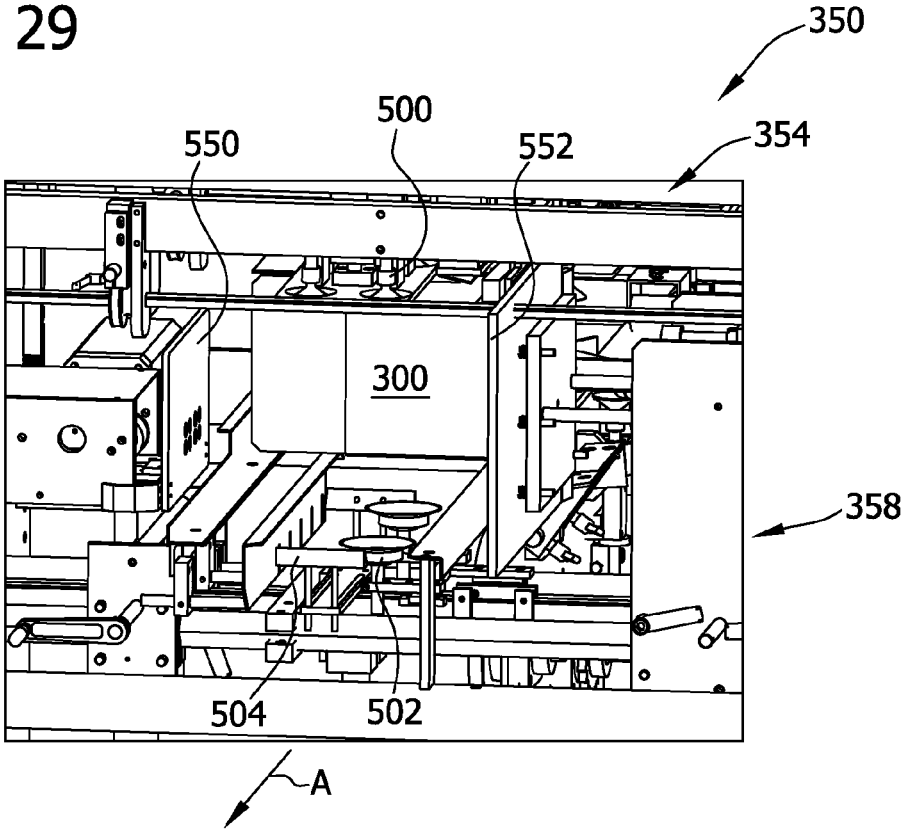
FIG. 29 is a perspective view of the upper suction cups of the second erecting mechanism shown in FIG. 4 attaching to the knocked-down flat container in the rectangular configuration shown in FIG. 7.
Figure 30:
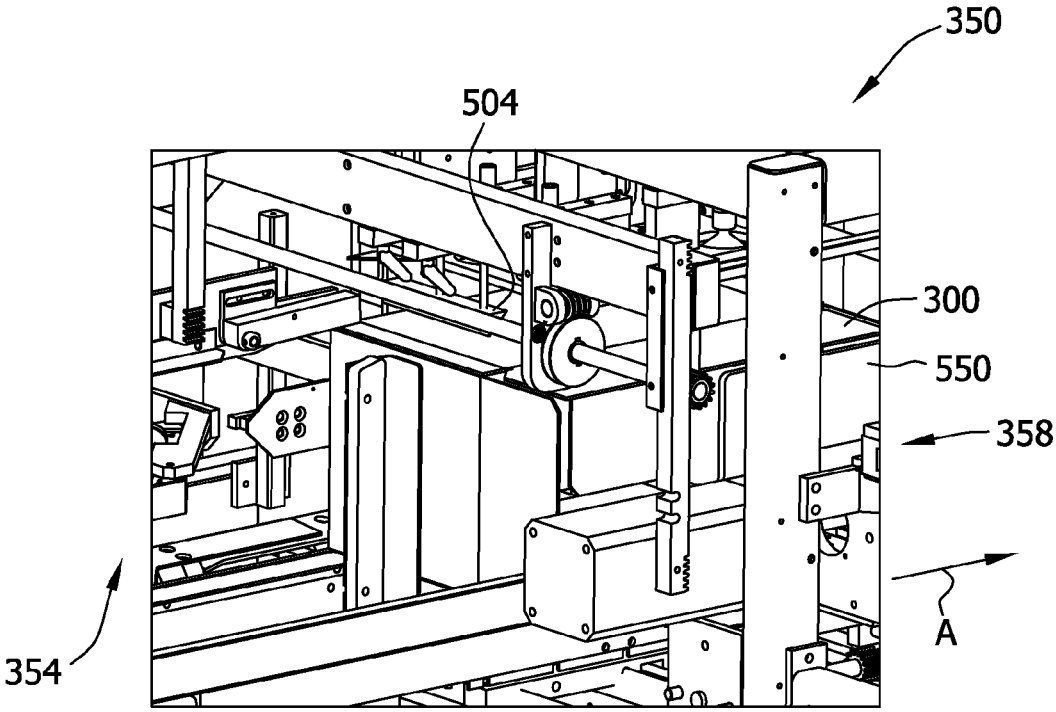
FIG. 30 is a perspective view of the second erecting mechanism shown in FIG. 4 erecting the knocked-down flat container shown in FIG. 3 into the octagonal container shown in FIG. 2.
Figure 31:
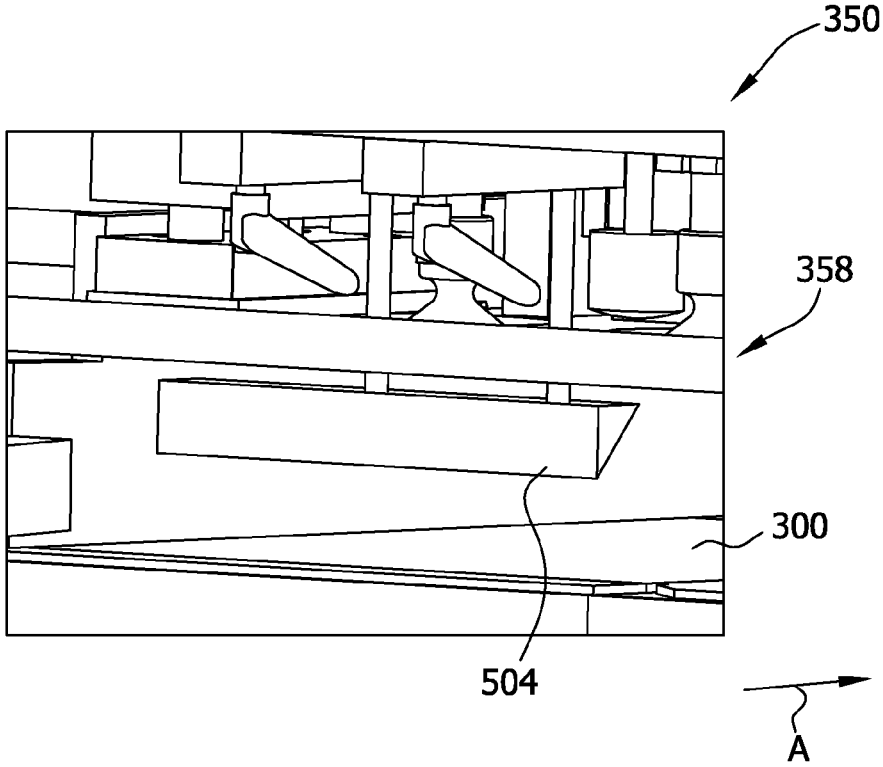
FIG. 31 is a perspective view of the miter bar shown in FIG. 4.
Figure 32:
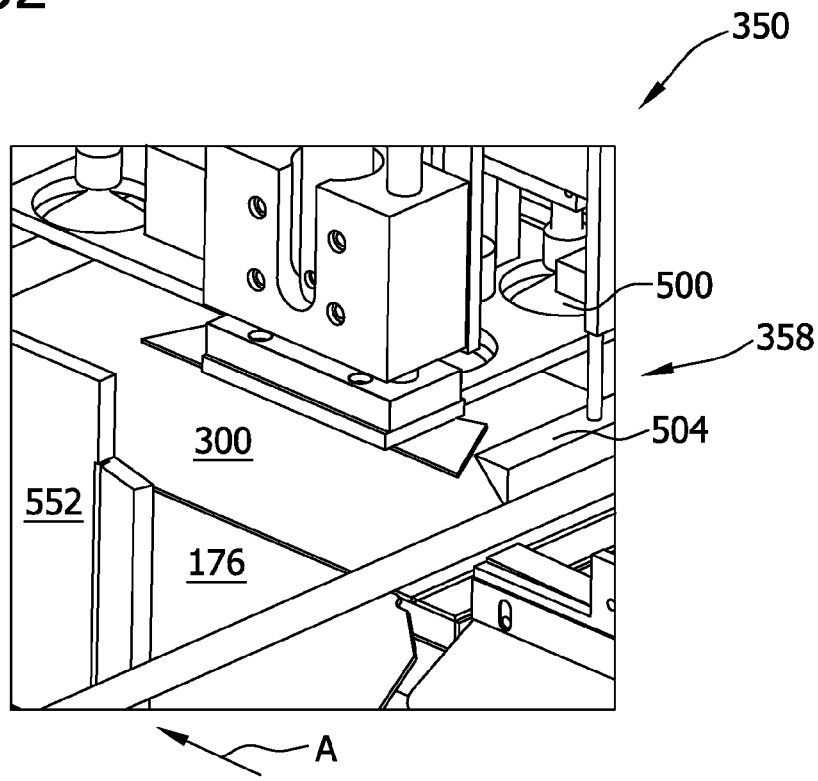
FIG. 32 is another perspective view of the second erecting mechanism shown in FIG. 4 erecting the knocked-down flat container shown in FIG. 3 into the octagonal container shown in FIG. 2.
Figure 33:
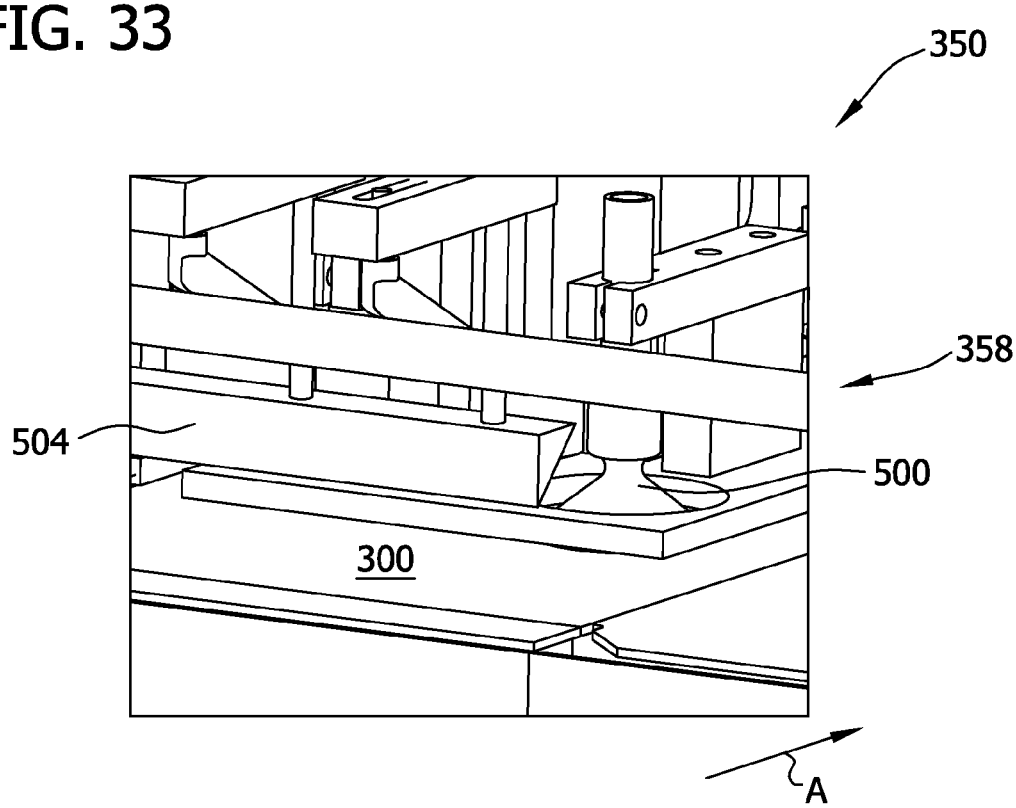
FIG. 33 is a perspective view of a miter bar shown in FIG. 4 as the second erecting mechanism shown in FIG. 4 erects the knocked-down flat container shown in FIG. 3 into the octagonal container shown in FIG. 2.
Figure 34:
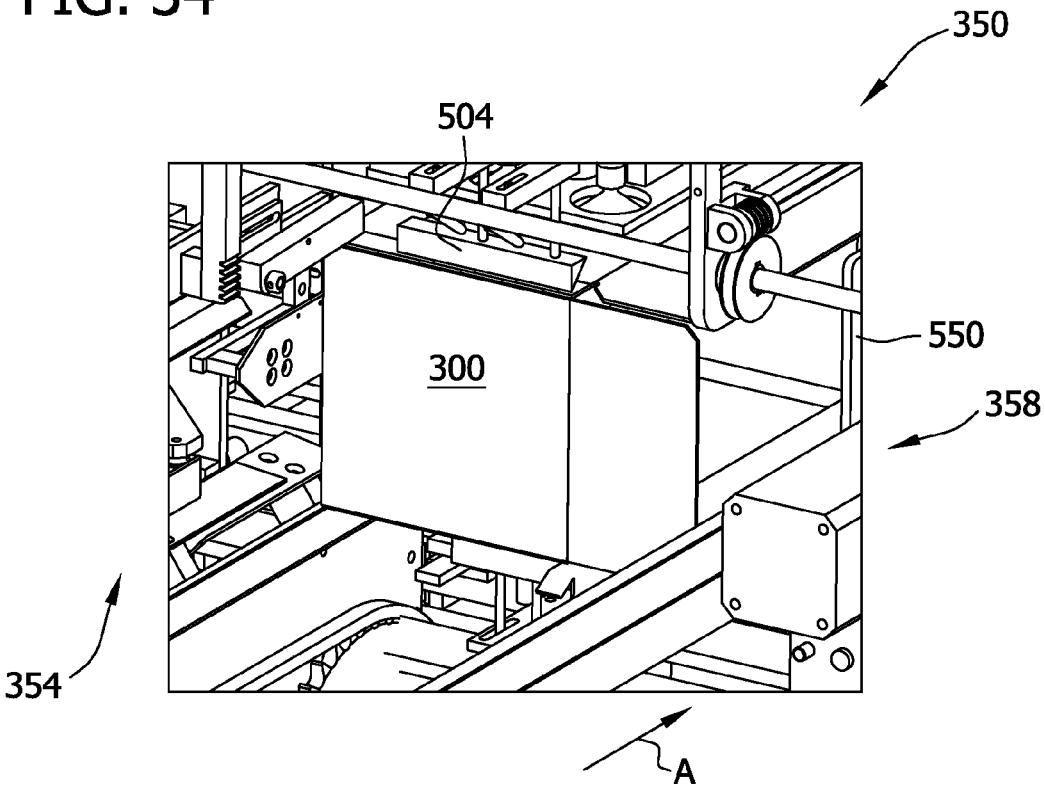
FIG. 34 is a further perspective view of the second erecting mechanism shown in FIG. 4 erecting the knocked-down flat container shown in FIG. 3 into the octagonal container shown in FIG. 2.
Figure 35:
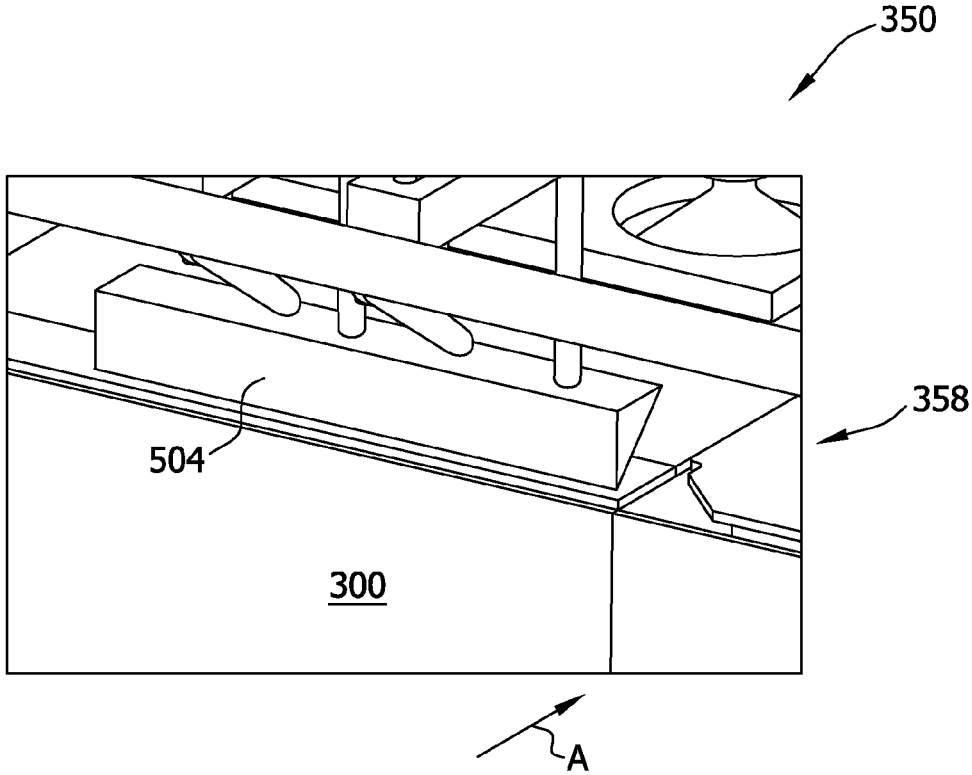
FIG. 35 is another perspective view of a miter bar shown in FIG. 4 as the second erecting mechanism shown in FIG. 4 erects the knocked-down flat container shown in FIG. 3 into the octagonal container shown in FIG. 2.
Figure 36:
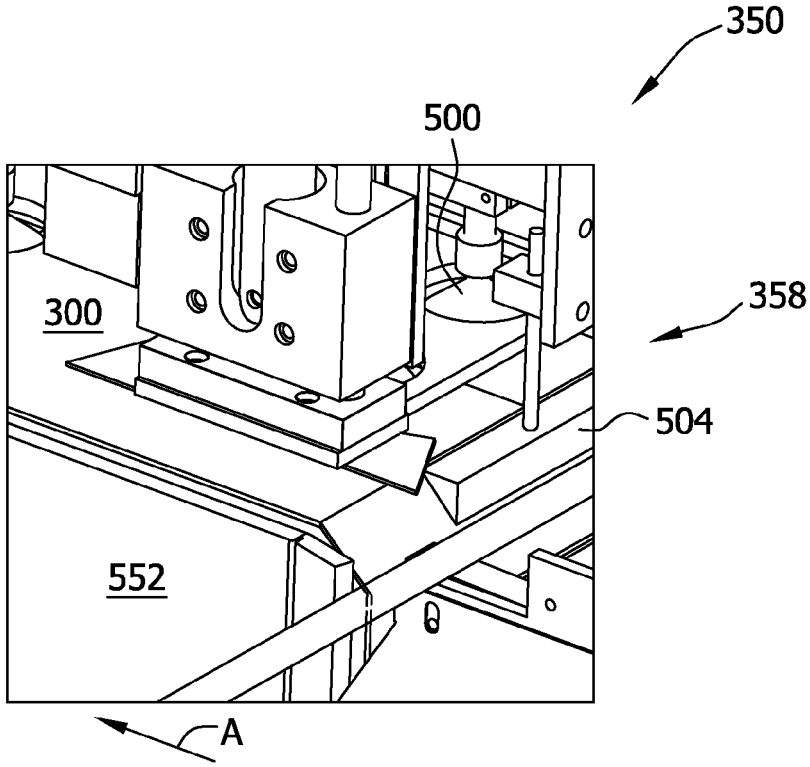
FIG. 36 is yet another perspective view of the second erecting mechanism shown in FIG. 4 erecting the knocked-down flat container shown in FIG. 3 into the octagonal container shown in FIG. 2.
Figure 37:
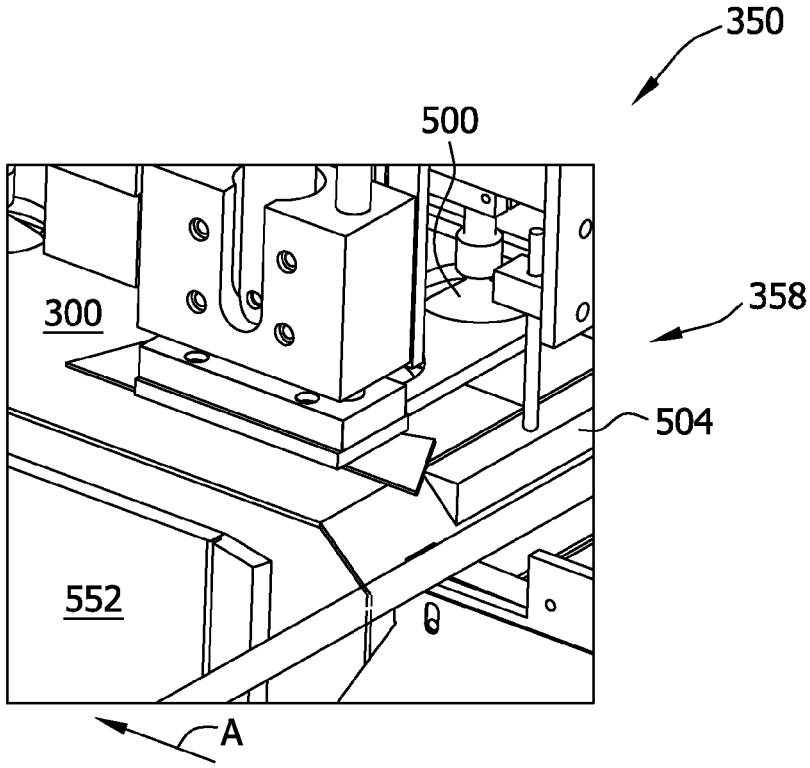
FIG. 37 is a perspective view of the second erecting mechanism shown in FIG. 4 erecting the knocked-down flat container shown in FIG. 3 into the octagonal container shown in FIG. 2.

FIGS. 29-37 show the rectangular configuration of the partially erected, knocked-down container 300 being formed into the octagonal container 200 by the second erecting mechanism 358. FIG. 29 shows the upper suction cups 500 of the second erecting mechanism 358 attaching to the rectangular configuration of the knocked-down flat container 300. FIGS. 30, 32, 34, 36, and 37 show the second erecting mechanism 358 erecting the octagonal container 200. FIGS. 31 and 33 show a miter bar 504 of the second erecting mechanism 358. FIG. 35 show a miter bar 504 shown of the second erecting mechanism 358 forming the corners of the octagonal container 200.

Figure 38:
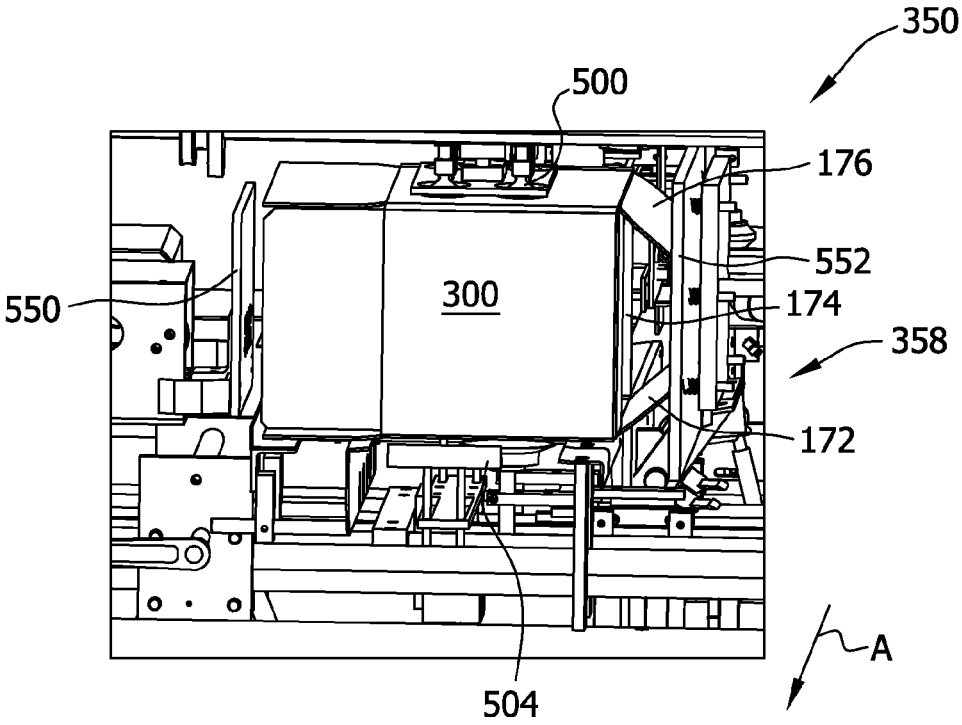
FIG. 38 is a perspective view of the backing plate and compression plate shown in FIG. 11 closing the bottom of the knocked-down flat container shown in FIG. 3.
Figure 39:
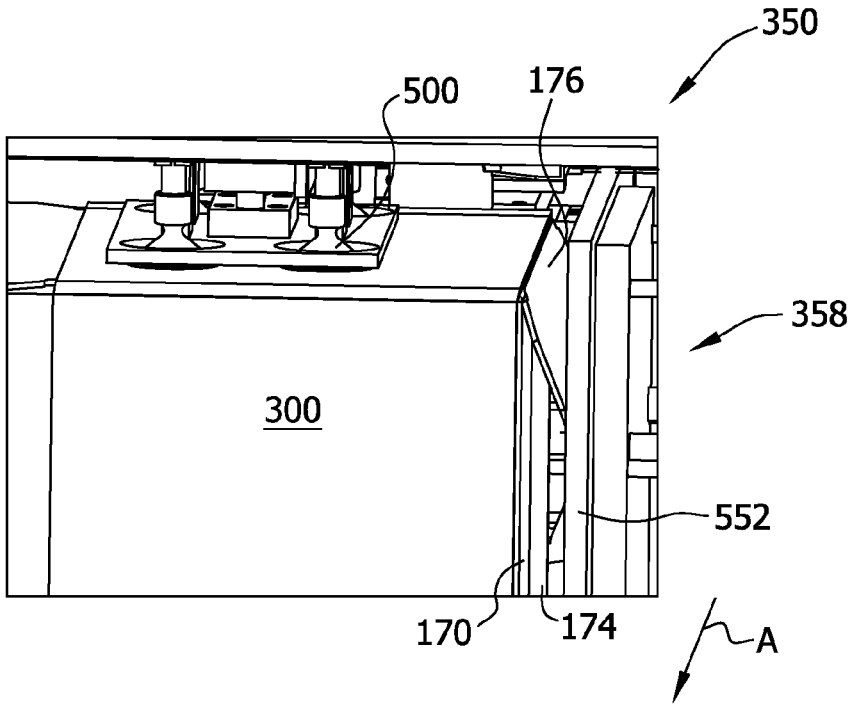
FIG. 39 is another perspective view of the backing plate and compression plate shown in FIG. 11 closing the bottom of the knocked-down flat container shown in FIG. 3.
Figure 40:
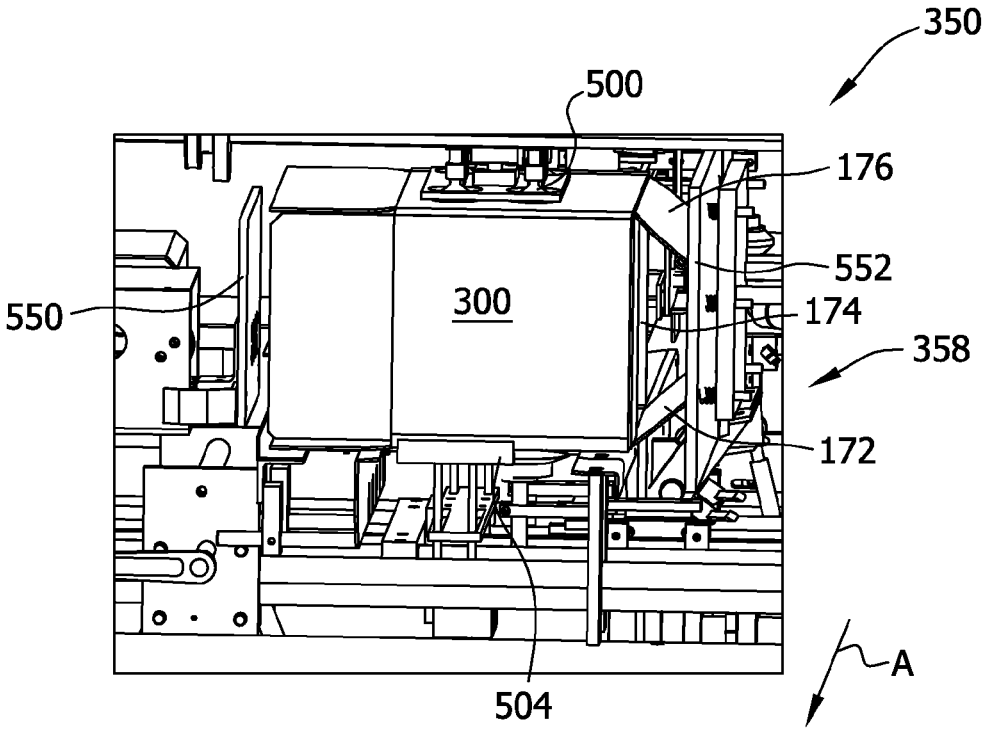
FIG. 40 is a further perspective view of the backing plate and compression plate shown in FIG. 11 closing the bottom of the knocked-down flat container shown in FIG. 3.
Figure 41:
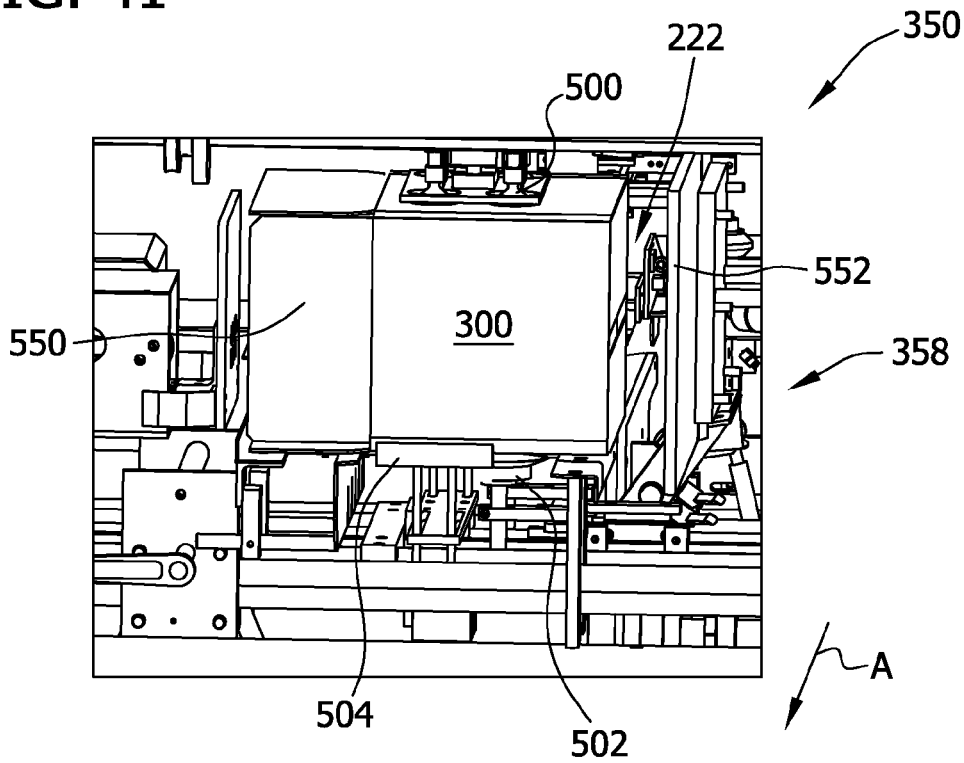
FIG. 41 is a view of the octagonal container shown in FIG. 2 at the second erecting mechanism shown in FIG. 4.
Figure 42:
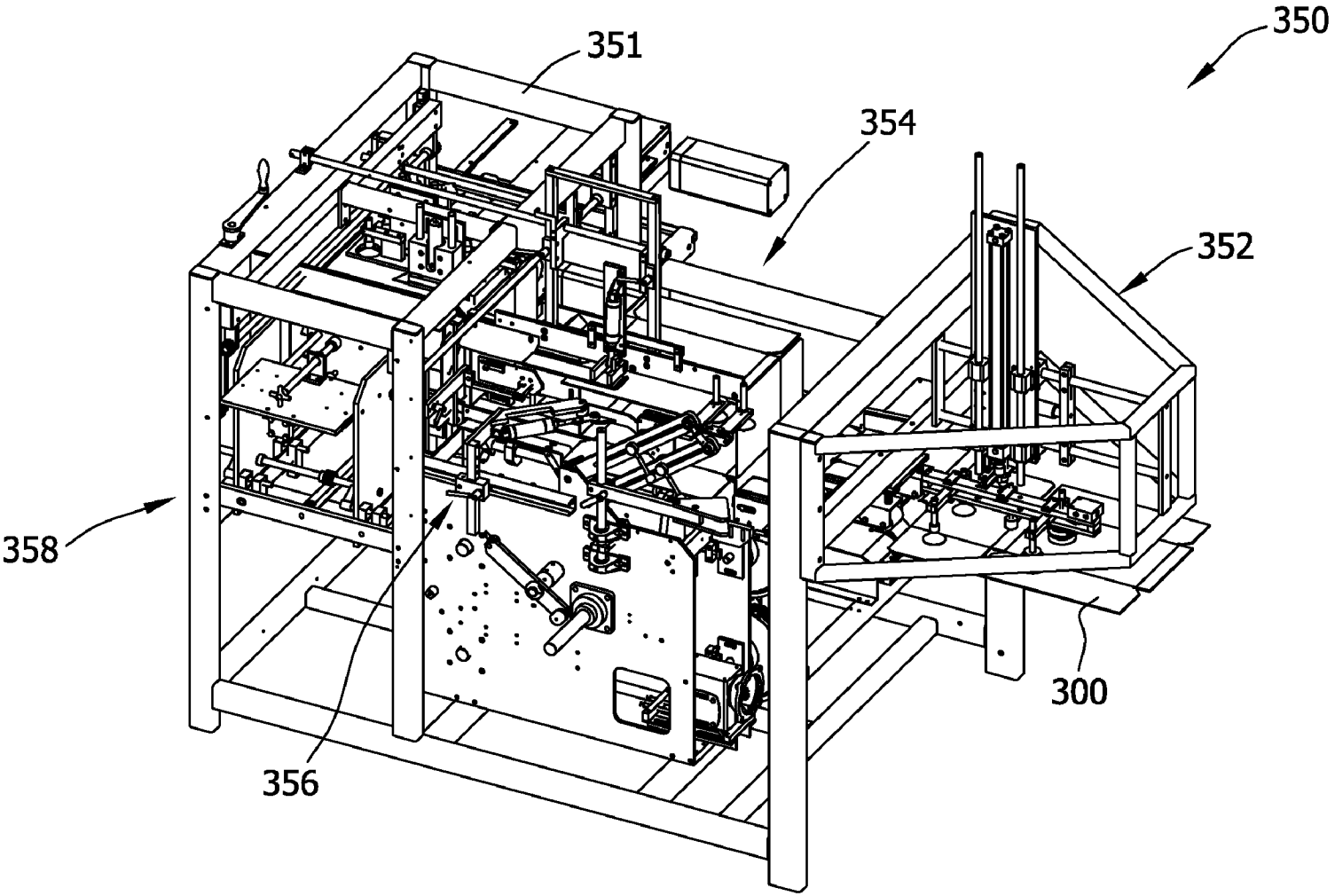
FIG. 42 is a perspective view of the machine shown in FIGS. 14-41.

FIGS. 38-41 show the bottom 220 of the octagonal container 200 being closed at the second erecting mechanism 358. FIGS. 38-40 show the backing plate 552 and compression plate 550 of the second erecting mechanism 358 closing the bottom 220 of the octagonal container 200. FIG. 41 shows a completed octagonal container 200 at the second erecting mechanism 358. FIG. 42 is a perspective view of machine 350 as shown in FIGS. 14-41.

Accordingly, the above-described machines and methods facilitate quickly and continuously forming polygonal containers, such as octagonal containers, from a stack of knocked-down flats. As such, time and/or costs associated with forming polygonal containers are facilitated to be reduced, thereby, reducing time and/or costs associated with manufacturing and packaging.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Exemplary embodiments of machines and methods for erecting a polygonal container are described above in detail. The machines and methods illustrated are not limited to the specific embodiments described herein, but rather, components of the machines may be utilized independently and separately from other components described herein. Further, steps described in the method may be utilized independently and separately from other steps described herein.

While the invention has been described in terms of various specific embodiments, those skilled in the art will recognize that the invention can be practiced with modification within the spirit and scope of the claims.

What is claimed is:

1. A machine for erecting a polygonal container from a knocked-down flat container formed from a blank of sheet material, the container including four main side panels, at least one corner panel extending between two of the main side panels, and at least one bottom flap extending from one of the main side panels for forming a bottom of the container, said machine comprising:

a body;

a first erecting mechanism coupled to said body; and a second erecting mechanism coupled to said body, said second erecting mechanism comprising an upper coupling device, a lower coupling device, and at least one miter bar, said first erecting mechanism receives the knocked-down flat container and erects the knocked-down flat container into a partially erected container having a substantially rectangular configuration; and said second erecting mechanism receives the partially erected container in the substantially rectangular configuration, said upper coupling device configured to couple to an upper side panel of the partially erected container, said lower coupling device configured to couple to a lower side panel of the partially erected container, wherein said upper coupling device, said lower coupling device and said at least one miter bar are configured to apply a force to an exterior surface of the partially erected container to erect the partially erected container from the rectangular configuration into the polygonal container, wherein the polygonal container includes more than four sides.

2. A machine in accordance with claim 1 wherein said first erecting mechanism comprises:

a first erecting arm rotatably coupled to said body;

at least one suction cup coupled to said first erecting arm; and a lower holding mechanism holds a lower side panel of the knocked-down flat container while said first erecting arm attaches said at least one suction cup to an upper side panel of the knocked-down flat container, said first erecting arm rotates at least the upper side panel of the knocked-down flat container to erect the knocked-down flat container into the partially erected container having the substantially rectangular configuration.

3. A machine in accordance with claim 1 wherein the polygonal container includes a first pair of opposing bottom flaps extending from a first pair of opposing main side panels, said first erecting mechanism comprises a first folding arm the folds the first pair of opposing bottom flaps to a substantially right angle with respect to the first pair of opposing main side panels.

4. A machine in accordance with claim 3 wherein the polygonal container includes a second pair of opposing bottom flaps extending from a second pair of opposing main side panels, said first erecting mechanism comprises a second folding arm that folds the second pair of opposing bottom flaps to a predetermined angle with respect to the second pair of opposing main side panels, said predetermined angle being less than approximately ninety degrees.

5. A machine in accordance with claim 1 further comprising a gluing mechanism coupled to said body between said first erecting mechanism and said second erecting mechanism, the partially erected container being transferred in the rectangular configuration proximate said gluing mechanism to said second erecting mechanism.

6. A machine in accordance with claim 5 wherein said glue mechanism applies a hot melt to that at least one bottom flap that is folded to less than a ninety degree angle with respect to a corresponding main side panel connected to the least one bottom flap.

7. A machine in accordance with claim 1 wherein said upper coupling device comprises at least one upper suction cup and said lower coupling device comprises at least one lower suction cup, said at least one upper suction cup and said at least one lower suction cup move the upper side panel and the lower side panel apart causing a leading side panel to move toward a trailing side panel of the partially erected container to form the polygonal container.

8. A machine in accordance with claim 1 wherein said at least one miter bar is fixed with respect to said body, said at least one miter bar applies the force to the at least one corner panel when the at least one corner panel is positioned against said at least one miter bar.

9. A machine in accordance with claim 1 wherein said second erecting mechanism comprises a backing plate and a compression plate, said compression plate moves toward said backing plate to press the at least one bottom flap for forming the bottom of the polygonal container.

10. A machine for erecting a polygonal container from a knocked-down flat container formed from a blank of sheet material, the container including four main side panels, at least one corner panel extending between two of the main side panels, and at least one bottom flap extending from one of the main side panels for forming a bottom of the container, said machine comprising:

means for erecting the knocked-down flat container into a partially erected container having a substantially rectangular configuration; and means for further erecting the partially erected container from the substantially rectangular configuration into the polygonal container by applying a force to an exterior surface of the at least one corner panel using a miter bar positioned adjacent the exterior surface of the at least one corner panel, wherein the polygonal container has more than four sides.

11. A machine in accordance with claim 10 wherein said means for erecting further comprises:

means for holding a lower side panel of the knocked-down flat container; and means for attaching to an upper side panel of the knocked-down flat container while the lower side panel is being held, said means for attaching rotates at least the upper side panel of the knocked-down flat container to erect the knocked-down flat container into the substantially rectangular configuration.

12. A machine in accordance with claim 10 wherein the polygonal container includes a plurality of bottom flaps each extending from a corresponding one of the main side panels, said means for erecting further comprises:

means for folding a first pair of opposing bottom flaps to a substantially right angle with respect to a first pair of opposing main side panels connected to the first pair of bottom flaps; and means for folding a second pair of opposing bottom flaps to a predetermined angle with respect to a second pair of opposing main side panels connected to the second pair of bottom flaps, the predetermined angle being less than approximately ninety degrees.

13. A machine in accordance with claim 10 wherein the polygonal container includes a plurality of bottom flaps each extending from a corresponding one of the main side panels, said machine further comprising:

means for applying adhesive to a pair of opposing bottom flaps that are folded to less than a ninety degree angle with respect to a pair of corresponding, connected main side panels when the partially erected container is transferred in the substantially rectangular configuration proximate said means for applying adhesive to said means for further erecting.

14. A machine in accordance with claim 10 wherein said means for further erecting further comprises:

means for attaching to an upper side panel of the partially erected container in the substantially rectangular configuration; and means for attaching to a lower side panel of the partially erected container in the substantially rectangular configuration, said means for attaching to the upper side panel and said means for attaching to the lower side panel move the upper side panel and the lower side panel apart causing a leading side panel to move toward a trailing side panel of the partially erected container to form the polygonal container.

15. A machine in accordance with claim 10 wherein said at least one miter bar is fixed with respect to a body of said machine, said at least one miter bar applies the force to the exterior surface of the at least one corner panel when the at least one corner panel is positioned against said at least one miter bar.

16. A machine in accordance with claim 10 wherein said means for further erecting further comprises:

means for applying a force to an exterior surface of the at least one bottom flap; and means for applying a force to an interior surface of the at least one bottom flap, said means for applying a force to the interior surface moves toward said means for applying a force to the exterior surface to press the at least one bottom flap for forming the bottom of the polygonal container.

17. A method for erecting a polygonal container from a knocked-down flat container formed from a blank of sheet material, the container includes four main side panels, at least one corner panel extending between two of the main side panels, and at least one bottom flap extending from one of the main side panels for forming a bottom of the container, the polygonal container is formed using a machine that includes a body, a first erecting mechanism coupled to the body, and a second erecting mechanism coupled to the body, the second erecting mechanism including an upper coupling device and a lower coupling device, said method comprising:

receiving the knocked-down flat container at the first erecting mechanism;

erecting the knocked-down flat container into a partially erected container having a substantially rectangular configuration at the first erecting mechanism;

transferring the partially erected container in the substantially rectangular configuration to the second erecting mechanism;

coupling the upper coupling device to an upper side panel of the partially erected container;

coupling the lower coupling device to a lower side panel of the partially erected container; and applying a force to an exterior surface of the partially erected container using the second erecting mechanism to erect the partially erected container in the substantially rectangular configuration into the polygonal container, wherein the polygonal container has more than four sides.

18. A method in accordance with claim 17 wherein the first erecting mechanism includes a first erecting arm and a lower holding mechanism, erecting the knocked-down flat container into a rectangular configuration at the first erecting mechanism further comprising:

holding a lower side panel of the knocked-down flat container using the lower holding mechanism while the first erecting arm attaches a suction cup to an upper side panel of the knocked-down flat container; and rotating a portion of the knocked-down flat container into the rectangular configuration using the first erecting arm.

19. A method in accordance with claim 17 wherein the polygonal container includes a first pair of opposing bottom flaps extending from a first pair of opposing main side panels, and the first erecting mechanism includes a first folding arm, erecting the knocked-down flat container into a rectangular configuration at the first erecting mechanism further comprising:

folding the first pair of opposing bottom flaps to a substantially right angle with respect to the first pair of opposing main side panels using the first folding arm.

20. A method in accordance with claim 19 wherein the polygonal container includes a second pair of opposing bottom flaps extending from a second pair of opposing main side panels, and the first erecting mechanism includes a second folding arm, erecting the knocked-down flat container into a rectangular configuration at the first erecting mechanism further comprising:

folding the second pair of opposing bottom flaps to a predetermined angle with respect to the first pair of opposing main side panels using the second folding arm, the predetermined angle being less than approximately ninety degrees.

21. A method in accordance with claim 17 wherein the machine includes a gluing mechanism, transferring the partially erected container in the substantially rectangular configuration to the second erecting mechanism further comprising:

transferring the partially erected container in the substantially rectangular configuration proximate the gluing mechanism;

applying glue to the at least one bottom panel of the partially erected container; and transferring the partially erected container with the applied glue to the second erecting mechanism.

22. A method in accordance with claim 17 wherein coupling the upper coupling device further comprises attaching at least one upper suction cup to the upper side panel of the partially erected container in the substantially rectangular configuration, and wherein coupling the lower coupling device further comprises attaching at least one lower suction cup to the lower side panel of the partially erected container in the substantially rectangular configuration, and wherein said method further comprises moving the upper side panel and the lower side panel in opposite directions causing a leading side panel to move toward a trailing side panel of the partially erected container to form the polygonal container.

23. A method in accordance with claim 17 wherein the second erecting mechanism includes at least one miter bar, applying a force to an exterior surface the at least one corner panel further comprising:

applying the force to the at least one corner panel of the partially erected container in the substantially rectangular configuration by positioning the at least one miter bar against the exterior surface of the at least one corner panel.

24. A method in accordance with claim 17 wherein the second erecting mechanism includes a backing plate and a compression plate, said method further comprising:

moving the compression plate toward the backing plate; and applying pressure to the at least one bottom flap with the compression plate and the backing plate to secure the at least one bottom flaps for forming the bottom of the polygonal container.

* * * * *